US008205384B2

(12) United States Patent
Fraser

(10) Patent No.: US 8,205,384 B2
(45) Date of Patent: Jun. 26, 2012

(54) SHUTTER FOR COVERING NON-RECTANGULAR ARCHITECTURAL OPENINGS

(75) Inventor: Donald E. Fraser, Owensboro, KY (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 470 days.

(21) Appl. No.: 12/465,204

(22) Filed: May 13, 2009

(65) Prior Publication Data

US 2009/0293400 A1 Dec. 3, 2009

Related U.S. Application Data

(60) Provisional application No. 61/056,584, filed on May 28, 2008.

(51) Int. Cl.
*E06B 7/08* (2006.01)

(52) U.S. Cl. ..... 49/74.1; 49/505

(58) Field of Classification Search ..... 49/74.1, 49/77.1, 87.1, 91.1, 403, 504, 505
See application file for complete search history.

(56) References Cited

U.S. PATENT DOCUMENTS

| | | | | |
|---|---|---|---|---|
| 1,544,326 | A * | 6/1925 | Lelansky | 49/87.1 |
| 5,471,789 | A * | 12/1995 | Faircloth | 49/74.1 |
| 6,449,903 | B1 * | 9/2002 | Borcherding | 49/74.1 |
| 6,810,619 | B2 * | 11/2004 | Wilson | 49/74.1 |
| 6,810,620 | B1 * | 11/2004 | Anderson et al. | 49/74.1 |
| 6,901,701 | B2 * | 6/2005 | Lee | 49/82.1 |
| 2006/0101717 | A1 * | 5/2006 | Marocco | 49/74.1 |

FOREIGN PATENT DOCUMENTS

CA 2 487 556 5/2006

* cited by examiner

*Primary Examiner* — Gregory J. Strimbu
(74) *Attorney, Agent, or Firm* — Camoriano and Associates; Theresa Fritz Camoriano; Guillermo Camoriano

(57) ABSTRACT

A shutter for covering for architectural openings having non-conventional geometries. The shutter may be used for covering a wide variety of shapes of openings, including arched, curved, circular, oval, triangular, hexagonal, square and rectangular geometries, as well as any combination of these geometries. A plurality of frame blocks form a frame of the shutter, each frame block having front and rear faces; a top surface; an outer surface; a vertical inner surface, and a horizontal bottom surface, wherein the bottom surface of a first block of the plurality of frame blocks rests on the top surface of a next lower second block of the plurality of frame blocks and extends inwardly beyond the vertical inner surface of the second block to define a cantilevered portion.

5 Claims, 33 Drawing Sheets

SHUTTER FOR COVERING NON-RECTANGULAR ARCHITECTURAL OPENINGS

This application claims priority from U.S. Provisional Application S/No. 61/056,584 filed May 28, 2008.

BACKGROUND

The present invention relates to shutters which can be used for coverings for architectural openings.

It is known to provide a window covering for a non-rectangular architectural opening, such as an arch. An example of such a window covering is described in Canadian Patent Application No. 2 487 556 filed on Nov. 12, 2004 (Inventor: Marocco, Mario), titled "Formed Arch", which is hereby incorporated herein by reference.

In Marocco, the louvers are cut along a curved line to form an arched outer shape. Then both ends of each louver are cut vertically at a point inwardly from the outer edge, so each louver is in three parts. The two outer parts of each louver are secured to an arch frame element and are a stationary part of the frame, while the central part is pivotably mounted to the outer parts. The pivotable central portion and the outer, non-pivotable frame portions line up perfectly, to resemble one continuous louver, when the pivotable central louver portion is fully closed room-side down. There is a degree of overlap of the louvers to ensure full closure in the room-side down configuration. In this fully-closed, room-side down configuration, the top edge of one pivotable louver portion overlaps the bottom edge of the next higher pivotable louver portion as well as overlapping the bottom edges of the non-pivotable frame portions on either side of that next higher pivotable louver portion.

However, as explained in more detail later with respect to FIGS. 50, 51, and 52 of this specification, when the Marocco shutter is fully closed in the room-side up configuration, the top edge of each pivotable louver portion abuts the bottom edges of the two non-pivotable portions of the louver immediately above it, which stops its pivoting motion before it can reach the bottom edge of the central, pivotable louver portion. As a result, the closure of the shutter is not complete.

SUMMARY

The present invention provides a pivotable louver portion and a non-pivotable frame portion wherein the pivotable louver portion pivots to fully closed configurations both room-side up and room-side down.

DESCRIPTION

FIGS. 1 through 49 illustrate various embodiments of shutters. While an arched shape is described in detail, the components that are used to make the arched shutters also may be used for shutters having various "non-conventional" (i.e. non-rectangular) geometries, including arches (See FIG. 39A), octagons (See FIG. 39C), circles (See FIG. 39B), triangles (See FIG. 39D), hexagons, semi-circles, and/or combinations of geometries, such as a rectangular opening topped by an arch.

Figure 1:
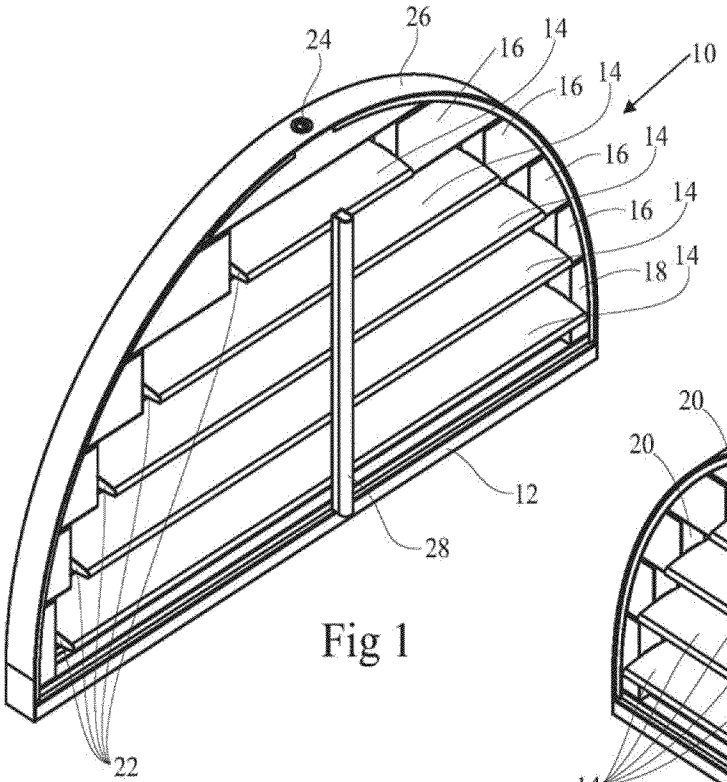
FIG. 1 is a room-side perspective view of one example of a shutter made in accordance with the present invention.
Figure 2:
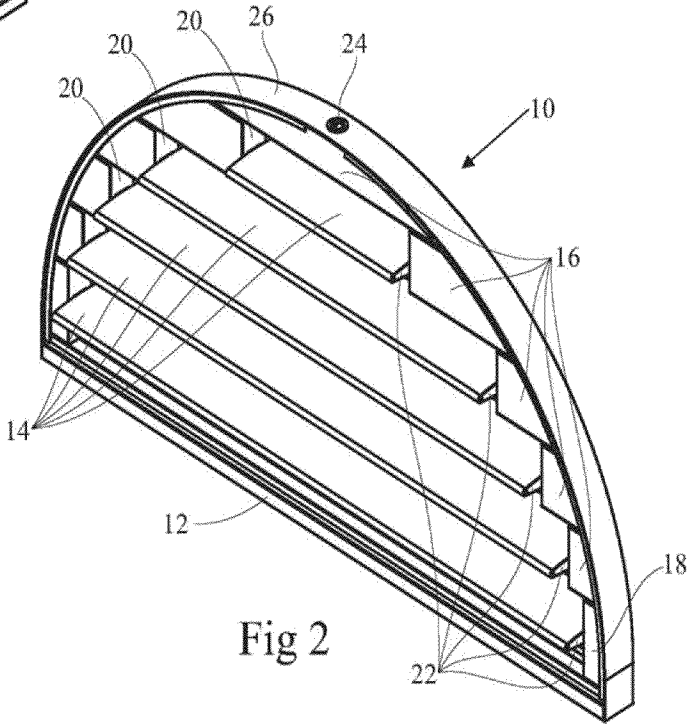
FIG. 2 is a wall-side perspective view of the shutter of FIG. 1.
Figure 3:
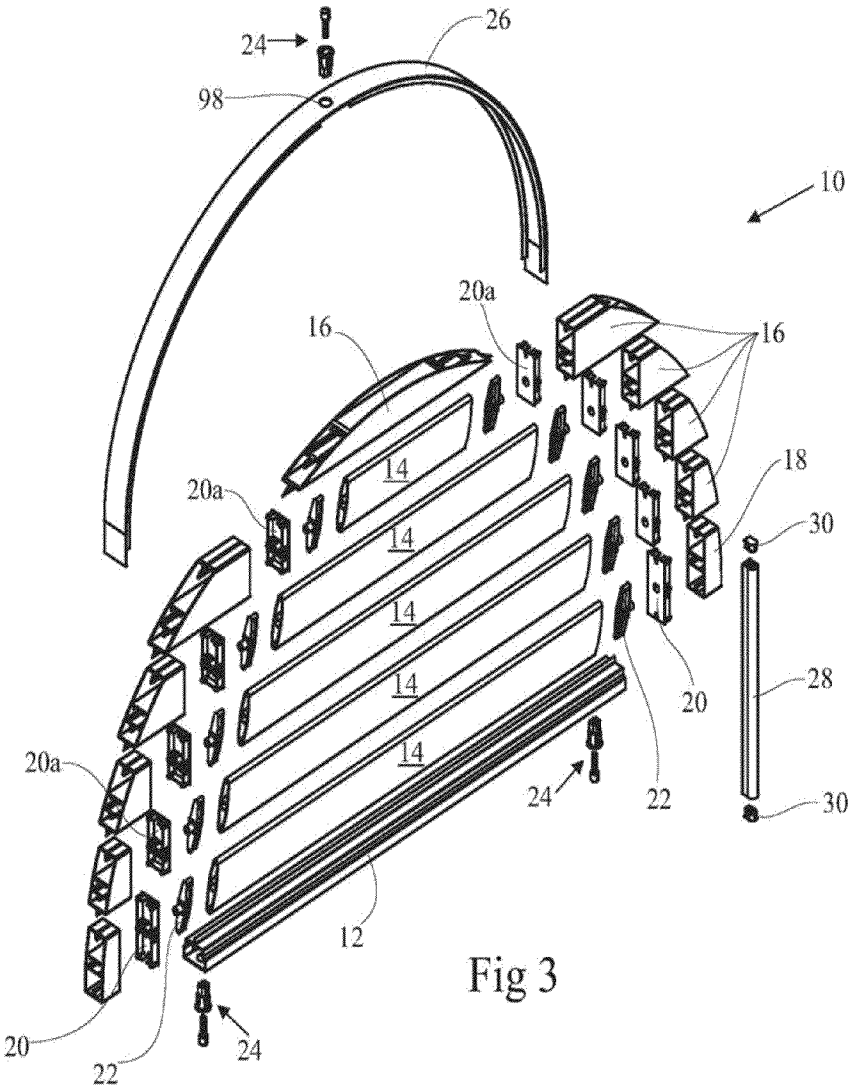
FIG. 3 is an exploded, perspective view of the shutter of FIG. 1.

FIG. 1 is a room-side perspective view of one embodiment of a shutter 10 made in accordance with the present invention. FIG. 2 is a wall-side view of the shutter 10 of FIG. 1, and FIG. 3 is an exploded, perspective view of the shutter 10 of FIG. 1.

As best appreciated in FIG. 3, the shutter 10 includes a bottom rail 12, parallel pivotable louvers 14, male-to-female frame blocks 16, female-to-female frame blocks 18, frame end caps 20, louver end caps 22, frame locking plungers 24, an arched element 26, a tilt bar 28, and tilt bar end caps 30, as described in more detail below.

Figure 6:
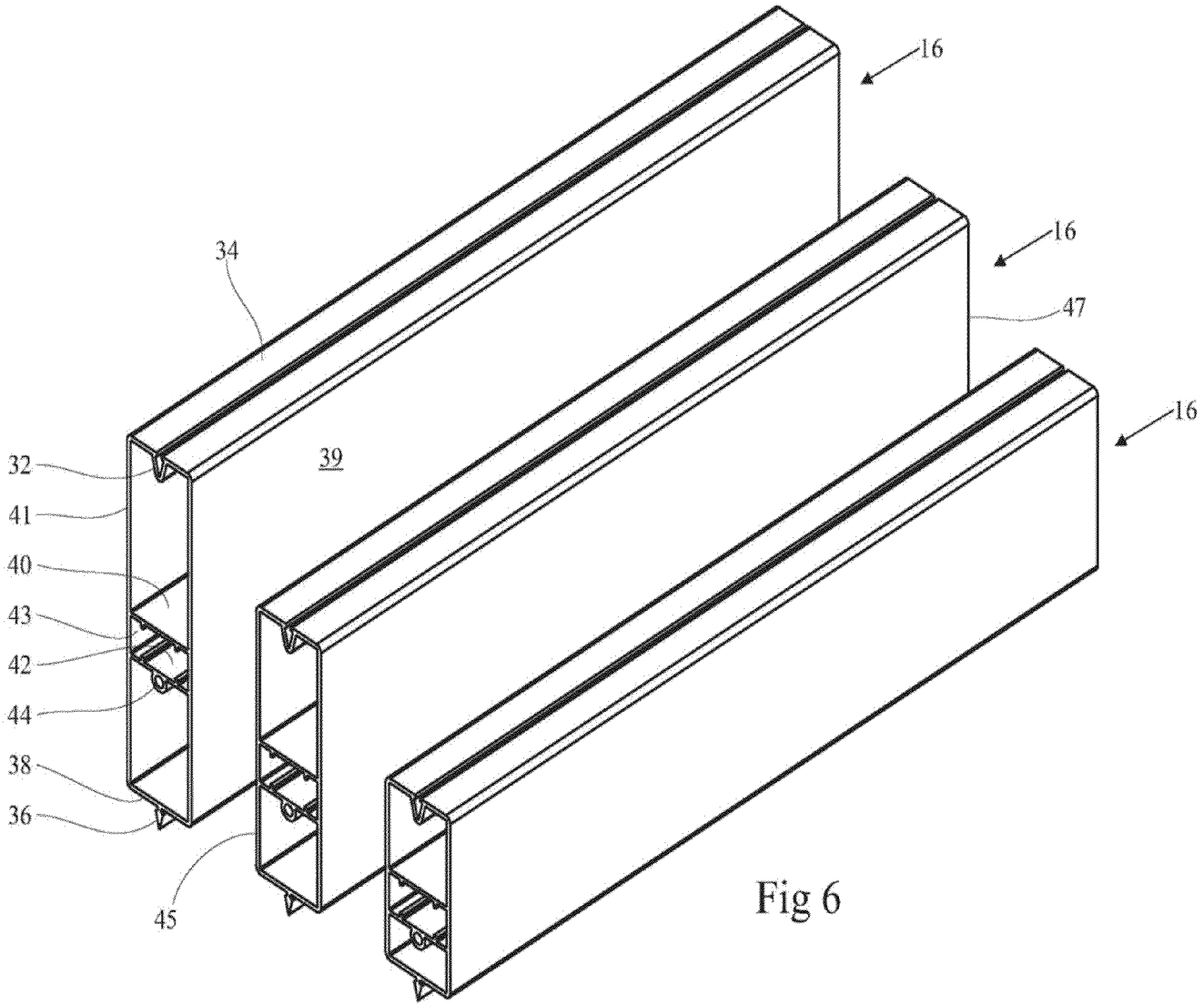
FIG. 6 is a perspective view of three different sizes of male-to-female frame blocks for use with different heights of louvers in the shutter of FIG. 1.

Referring to FIG. 6, the male-to-female frame blocks 16 may be manufactured in different heights depending on the height of the louvers 14 to be used in the shutter 10. The sizes depicted in FIG. 6 are for use with louvers which are 4½ inches high (in the background), 2½ inches high (in the foreground), and 3½ inches high (in the middle). Except for this height difference, the frame blocks 16 are otherwise identical and are thus generically described below.

In this embodiment, the male-to-female frame blocks 16 are rectangular-profiled, plastic (PVC) extrusions having a top surface 34, an outer surface 45, a vertical inner surface 47, a horizontal bottom surface 38, a front face 39, and a rear face 41. Each frame block 16 defines a lengthwise direction from its outer surface 45 to its inner surface 47. A "V" shaped indentation 32 extends lengthwise along the top surface 34, midway between the front and rear faces 39, 41, and a corresponding "V" shaped projection 36 extends lengthwise along the horizontal bottom surface 38 midway between the front and rear faces 39, 41. As described in more detail below, the blocks 16 are stacked on top of each other with the "V" shaped projection 36 of the upper block 16 being received in the "V" shaped indentation 32 of the adjacent lower block 16 in order to form a shutter frame. As noted later (and illustrated in FIGS. 42 and 43), the "V" shaped projection 36 also serves as a light stop against which the louvers 14 rest when the shutter 10 is in the fully closed configuration, either room-side up or room-side down. In this embodiment, since the "V" shaped indentation 32 and the "V" shaped projection 36 are located midway between the front and rear faces 39, 41, they are recessed from both the front and rear faces 39, 41 of the frame blocks 16.

Upper and lower internal webs 40, 42 extend along the full length of the block from the interior of the front face 39 to the interior of the rear face 4. A rectangular cavity 43 is defined between the upper and lower internal webs 40, 42 and the front and rear faces 39, 41 of the block 16. This cavity 43 houses a drag brake in the frame end cap 20, as described in more detail later. The block 16 also defines a cylindrical cavity 44 (or screw runner 44), which extends the length of the block 16. This screw runner 44 may be used to secure certain items (such as frame end caps 20, a vertical element described in a later embodiment, or the arched element 26) to the blocks 16 by threading a screw into this screw runner 44. Since these particular blocks 16 are extruded, they have the same cross-section along their entire length.

Figure 7:
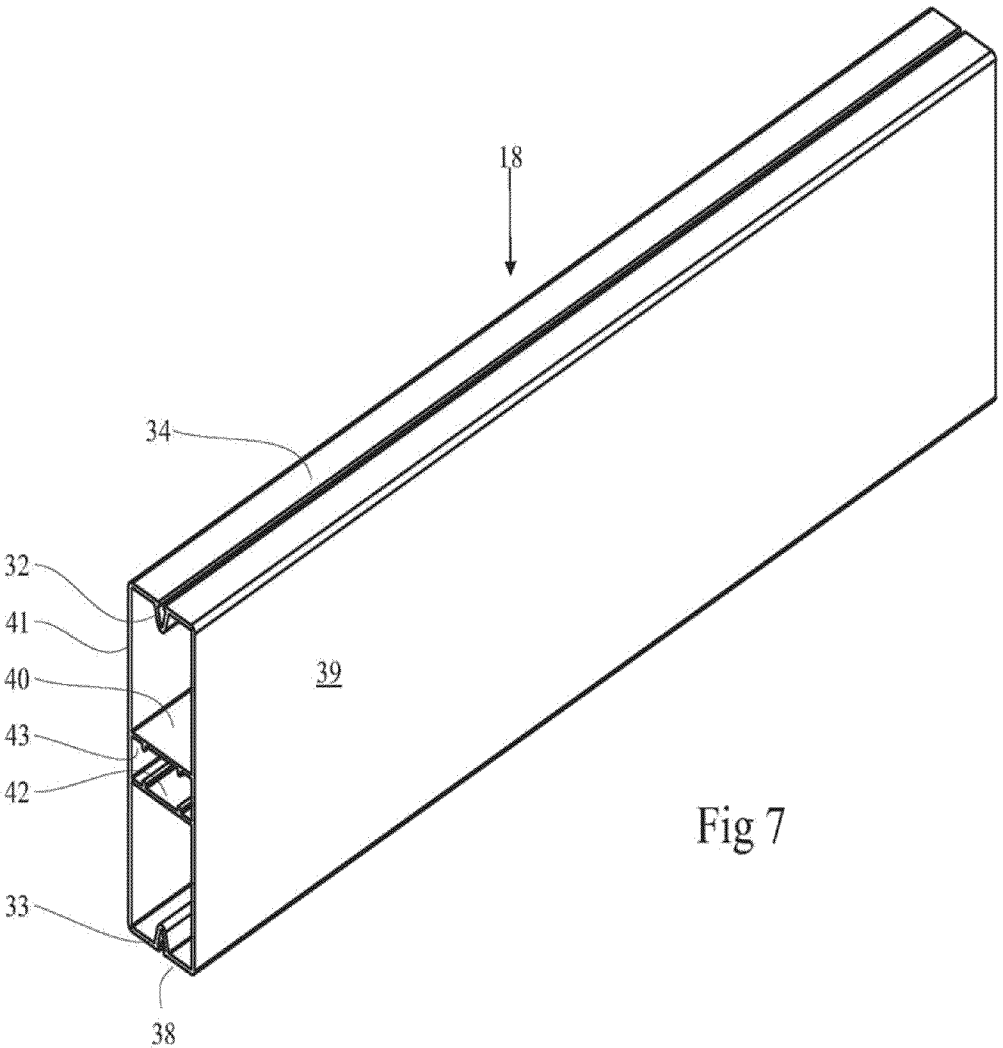
FIG. 7 is perspective view of a female-to-female frame block for use in the shutter of FIG. 1.

FIG. 7 shows a female-to-female frame block 18 which is substantially identical to the male-to-female frame block 16 except that, instead of having a "V" shaped projection 36 along its bottom surface 38, it has a second "V" shaped indentation 33.

Figures 8A, 8B, 8C:
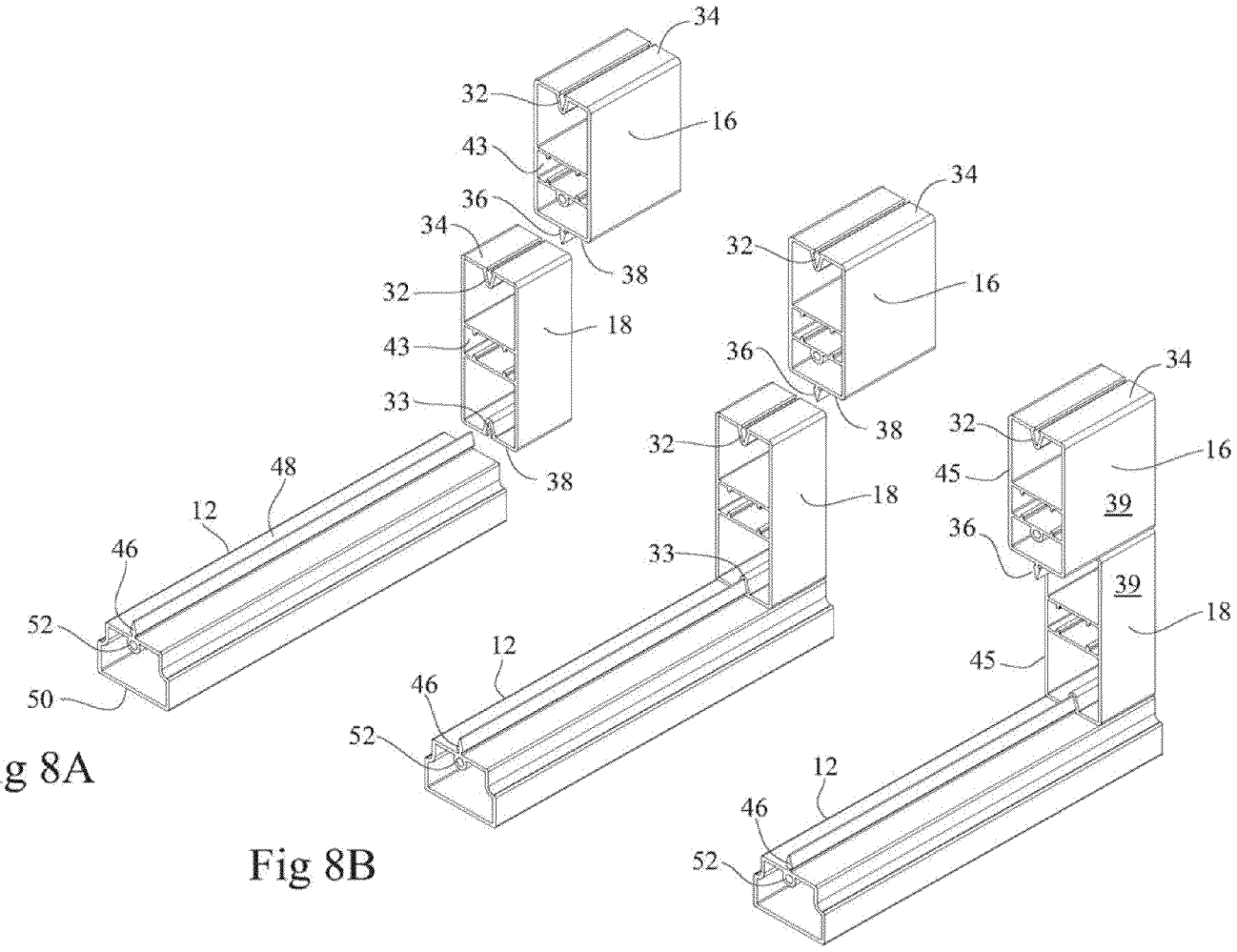
FIGS. 8A, 8B, and 8C are a series of perspective views showing the steps used to assemble a bottom rail to the female-to-female frame block of FIG. 7 and then to assemble that combination to one of the male-to-female frame blocks of FIG. 6.

The bottom rail 12 is shown in FIG. 8A. This is a rectangular-profiled body, similar to the male-to-female frame block 16, but having a "V" shaped projection 46 along its top surface 48 midway between its front and rear faces, and having a flat bottom surface 50. This "V" shaped projection 46 also serves as a light stop against which one of the edges 15, 17 (See FIG. 17) of the bottom louver 14 rests (overlaps) when the shutter 10 is in the fully closed configuration, either room-side up or room-side down, as may be appreciated in FIGS. 42 and 43. A screw runner 52, similar to the screw runner 44 of the male-to-female frame block 16, is included to aid in the assembly of the bottom rail 12 to a vertical member, as described in a later embodiment. Again, since this particular bottom rail 12 also is made by extrusion, it has the same cross-sectional profile along its entire length.

As shown in FIGS. 8A, 8B, and 8C, a female-to-female frame block 18 is stacked on top of the bottom rail 12 with the bottom surface 38 of the frame block 18 resting on the top surface 48 of the bottom rail 12, and with the "V" shaped projection 46 of the bottom rail 12 received in the "V" shaped indentation 33 of the female-to-female frame block 18 (See FIG. 8B). While FIGS. 8A-8C only show the frame block 18 at one end of the bottom rail 12, it is understood that the same process is repeated at the other end of the bottom rail 12, as shown in FIGS. 1-3.

Next, a male-to-female frame block 16 is stacked on top of the female-to-female frame block 18 such that the horizontal bottom surface 38 of the frame block 16 rests on the horizontal top surface 34 of the frame block 18, and the "V" shaped projection 36 on the bottom surface of the male-to-female frame block 16 is received in the "V" shaped indentation 32 on the top surface 34 of the female-to-female frame block 18 (See FIG. 8C).

As can be seen in FIG. 8C, the upper block 16 extends inwardly beyond the vertical inner surface 45 of the lower block 18 to define a cantilevered portion of the upper block 16 (the portion of the upper block 16 that extends inwardly beyond the vertical inner surface 45 of the lower block 18). When the upper block 16 is assembled to the lower block 18 as shown here, the front faces 39 of the upper and lower blocks 16, 18 are coplanar, and the rear faces 41 of the upper and lower blocks 16, 18 also are coplanar.

Figure 4:
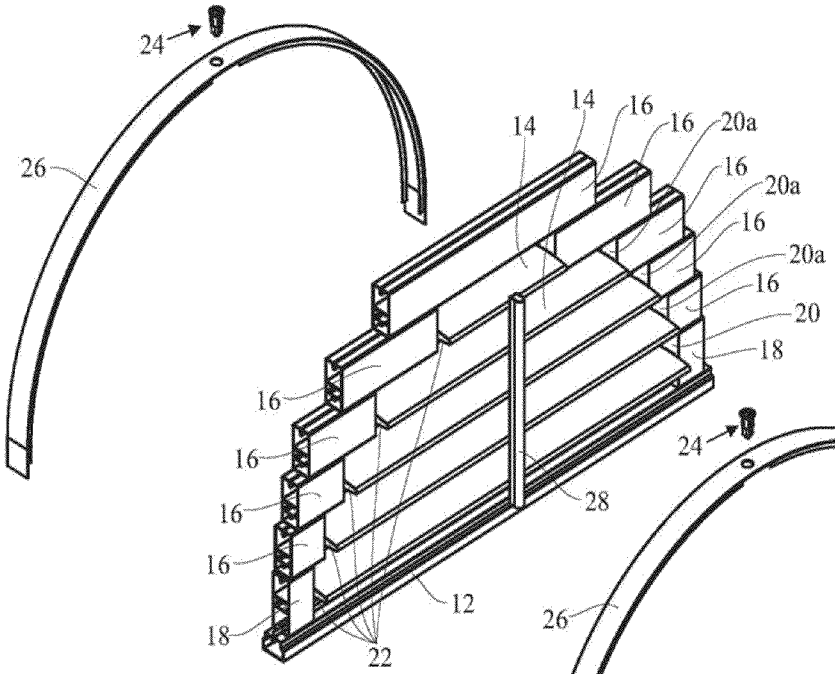
FIG. 4 is a partially exploded, perspective view of the shutter of FIG. 1, shown at an intermediate step of production just prior to trimming the frame blocks to conform to the shape of the arched element.

As may be appreciated by comparing FIG. 8C to FIG. 4, these are the preliminary steps in the manufacture of the shutter frame of the shutter 10. To continue the manufacture, the assembler continues to stack more blocks 16 on top of the previous blocks 16 to form the frame shown in FIG. 4.

Figure 10:
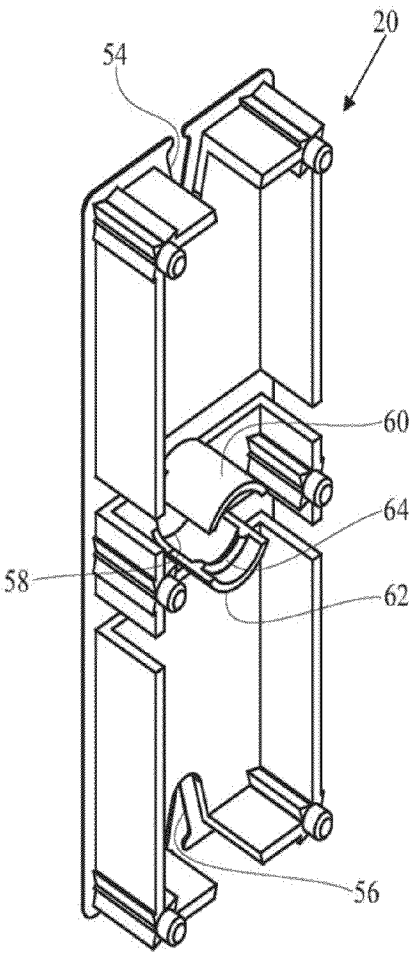
FIG. 10 is perspective view of the inside of the frame end cap of FIG. 9.
Figure 9:
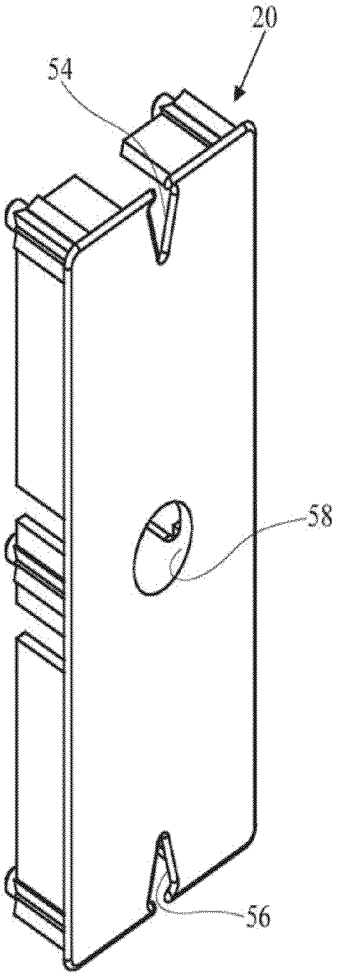
FIG. 9 is a perspective view of the outside of one of the frame end caps of FIG. 3.

FIGS. 9 and 10 show the outside and the inside, respectively, of one of the lower frame end caps 20 which snap onto the ends of the female-female frame blocks 18 to "finish" the appearance of the inside edges (the edges adjacent to the louvers 14) of these frame blocks 18. The lower frame end cap 20 has upper and lower "V" shaped indentations 54, 56 which make it suitable for snapping into a female-to-female frame block 18. As shown in FIG. 3, the frame end caps 20A for the male-to-female frame blocks 16 are the same as the lower frame end caps 20, except they have only the upper "V" shaped indentation 54 and are flat along their bottom edge, with no lower indentation 56.

The lower frame end caps 20 (and the regular frame end caps 20A), define a centrally located, through-opening 58 to provide pivotable support to the pivot shaft 66 of the louver end caps 22 (See FIGS. 11 and 12) as described in more detail below. Upper and lower arcuate members 60, 62 define segments of a raised ring 64 along their inner surfaces. The ring 64 is concentric with the pivot shaft 66 of the louver end cap 22 that is received between the upper and lower arcuate members 60, 62 and presses radially inwardly against the outer surface of the pivot shaft 66 of the louver end cap 22 to provide a drag resistance to rotation of its respective louver 14, which assists in keeping the louver 14 in position when the tilt bar 28 is released by the operator.

The frame end caps 20, 20A are designed so that the upper and lower arcuate members 60, 62 fit snugly into the rectangular cavity 43 of their respective frame blocks 16, 18, abutting the upper and lower webs 40, 42 of the rectangular cavity 43, which provide external support to these arcuate members 60, 62, preventing them from splaying outwardly and preventing material "creep".

The louver end caps 22 are mounted on the ends of the louvers 14, so the louvers can be pivotably mounted to the frame blocks so as to pivot about a horizontal axis from a completely closed room-side up position (See FIG. 43) in which the entire top and bottom edges of each louver overlap with an adjacent louver or with a V-shaped light stop projection from an adjacent frame block, to an open position, in which the top and bottom edges of the louvers lie in the same horizontal plane, to a completely closed room-side down position (See FIG. 42) in which the entire top and bottom edges of each louver overlap with an adjacent louver or with a light stop projection from an adjacent frame block. As explained in more detail later, the degree of overlap is indicated by the vertical distance 100 (See FIGS. 42 and 43), and this degree of vertical overlap is substantially the same in both completely closed positions.

Figure 12:
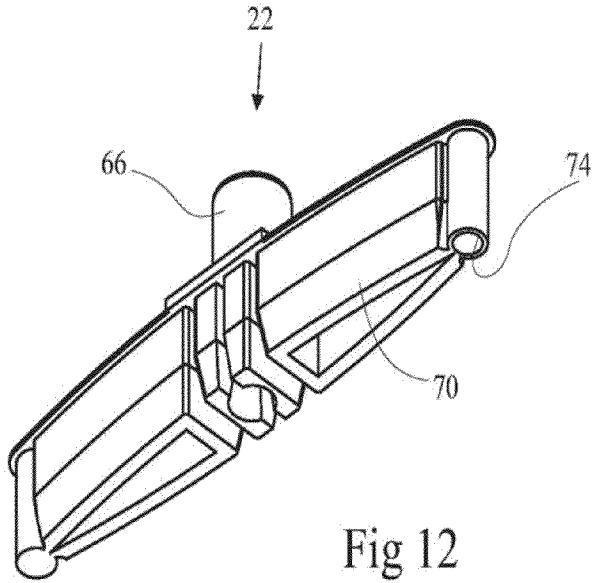
FIG. 12 is an opposite-end, perspective view of the louver end cap of FIG. 11.
Figure 11:
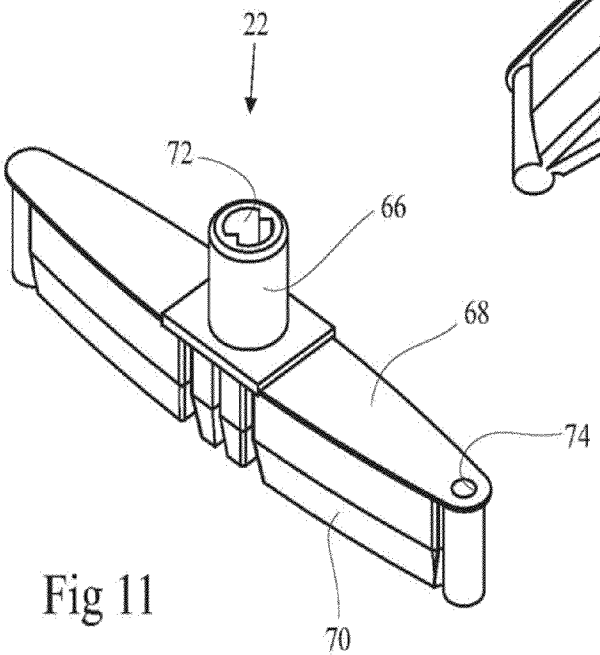
FIG. 11 is a perspective view of one of the louver end caps of FIG. 3.
Figure 13:
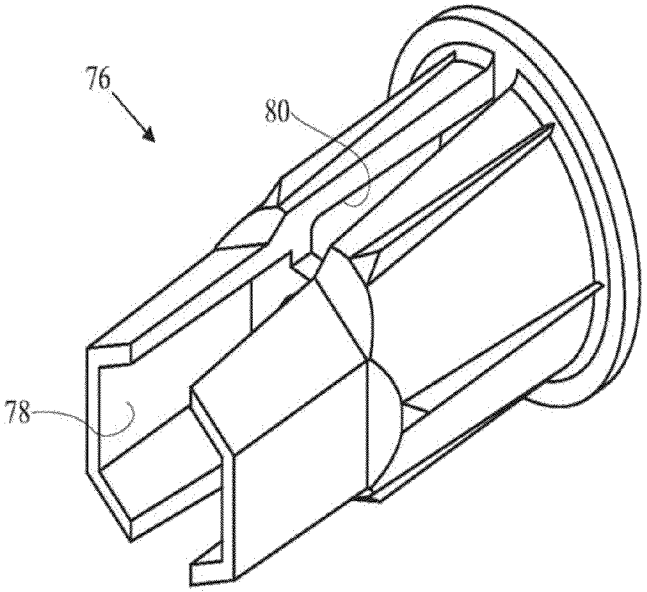
FIG. 13 is a perspective view of one of the plunger housings of FIG. 3.
Figure 14:
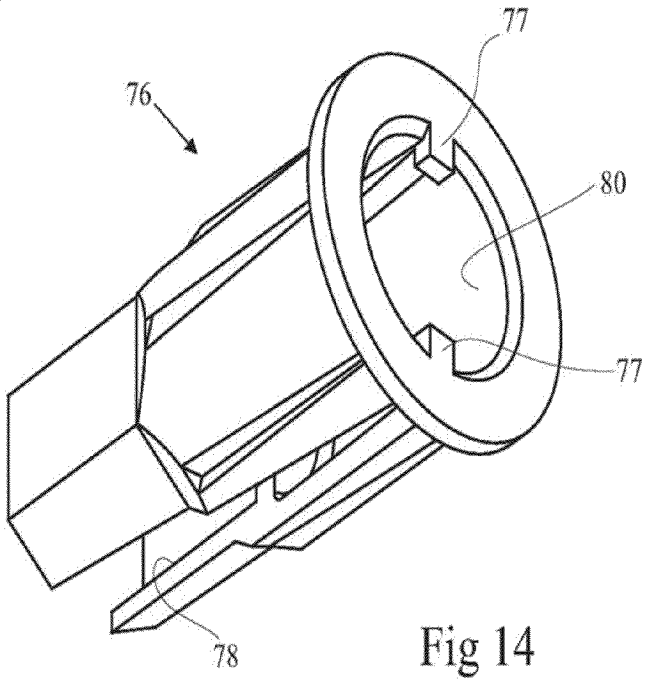
FIG. 14 is an opposite-end, perspective view of the plunger housing of FIG. 13.

FIGS. 11 and 12 depict a louver end cap 22. The louver end cap 22 defines an oval-profiled outer surface 68. Projecting outwardly from that oval outer surface 68 is the cylindrical pivot shaft 66. Projecting inwardly from that oval outer surface 68 is an inner oval-profiled portion 70 which is designed to snap into and engage the end of a louver 14. The pivot shaft 66 defines a hollow, non-circular profiled inner cavity 72 designed to engage a similarly-profiled coupling shaft as described in a later embodiment. The oval-profiled outer surface 68 also defines a small opening 74 at one end for pivotable engagement of a clear-view linkage as described in a later embodiment.

Figure 17:
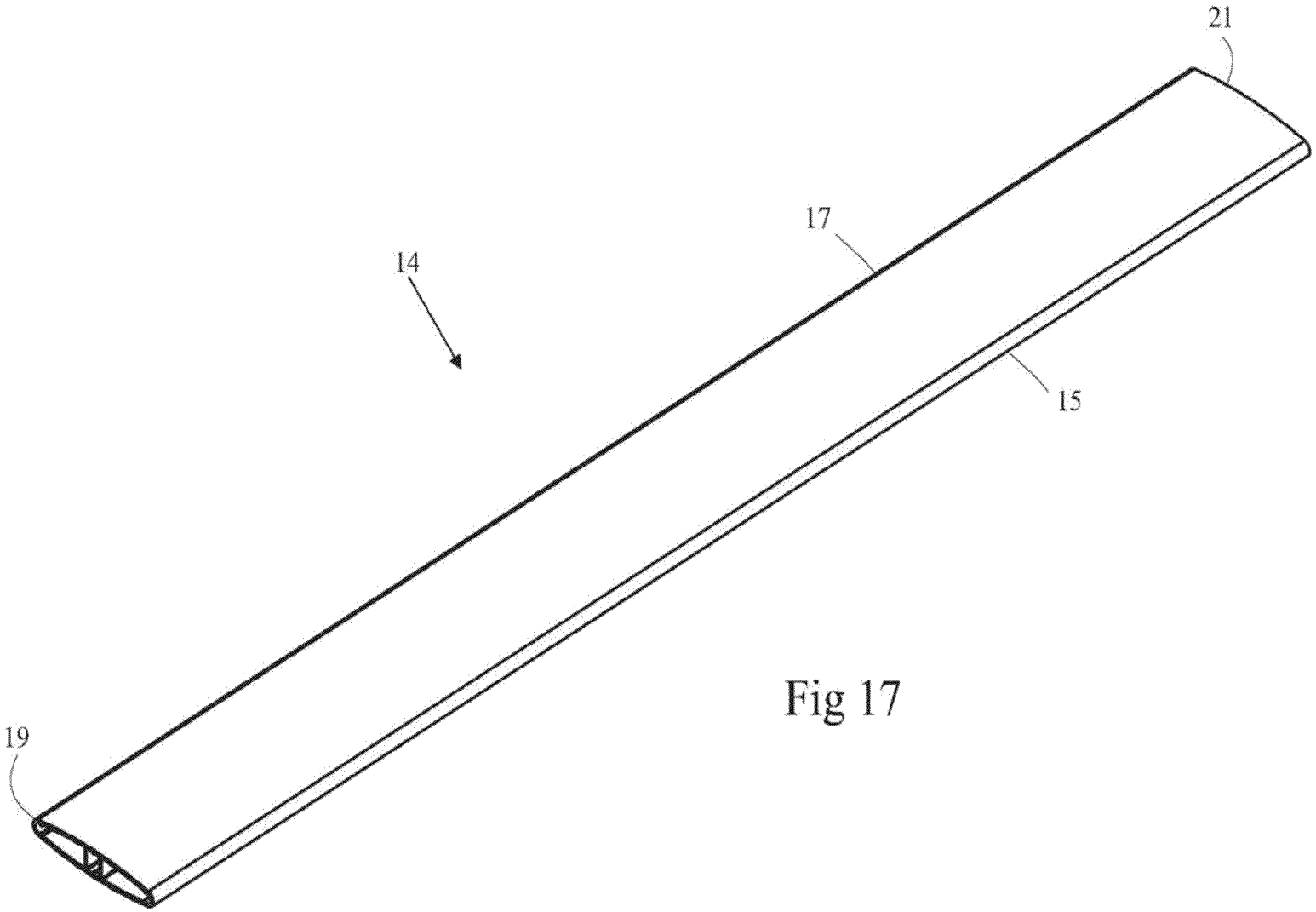
FIG. 17 is a perspective view of one of the louvers of FIG. 3.

FIG. 17 depicts one of the elongated louvers 14, which, in this embodiment, is also a plastic (PVC) extrusion with an oval-shaped cross-sectional profile to match the profile of its louver end caps 22. As discussed below, the louvers 14 are cut to the required length as part of the assembly process. Each louver 14 has first and second ends 19, 21 and defines a length from the first end 19 to the second end 21. Elongated first and second edges 15, 17 extend lengthwise from the first end 19 to the second end 21.

Referring now to FIG. 4, the basic framework of the shutter 10 includes a bottom rail 12 with a bottom frame block 18 at each end of the bottom rail, and with additional layers of frame blocks 16 stacked on top of lower frame blocks 16, 18. Each frame block 16 rests on the block below it and extends inwardly beyond the block below it to define a cantilevered portion. All the top surfaces 34 and bottom surfaces 38 of the frame blocks 16, 18 are horizontal and parallel to each other. At the top is a topmost frame block 16, which extends across and rests on two frame blocks 16. Each frame block except the topmost frame block 16 has a frame end cap 20 or 20A on its inner end. A louver 14 extends horizontally between each pair of left and right frame blocks 16 or 18. There are louver end caps 22 on both ends of each louver. The louvers 14 are cut to the desired length, and then louver end caps 22 are snapped in at both ends of each louver 14. The frame blocks 16, 18 are cut to the desired lengths and frame end caps 20, 20A are likewise snapped in at the inner ends of the frame blocks 16, 18.

A louver 14 is inserted between the two female-to-female frame blocks 18 such that the pivot shafts 66 of the louver end caps 22 extend through openings 58 (See FIGS. 9 and 10) of the frame end caps 20, 20A and are supported for rotation on the arcuate members 60, 62. This first louver "layer" is mounted onto the bottom rail 12 (See also FIG. 8B) sliding the blocks together (or, if the design allows, by snapping the blocks together) such that the "V" shaped projection 46 on the top surface of the bottom rail 12 is received in and engages the "V" shaped indentation 33 of the female-to-female lower frame block 18 and the bottom surfaces of the bottom-most blocks 18 rest on the top surface 48 of the bottom rail 12.

The next louver "layer", including a louver 14 of the appropriate length pivotably mounted between two male-to-female frame blocks 16, is then mounted on top of the first louver "layer", with the male projection 36 on the bottom surface 38 of the frame blocks 16 received in the female recess 32 on the top surface 34 of the bottom-most frame blocks 18 on the first layer, and with the bottom surface 38 of the frame blocks 16 resting on top of the top surface 34 of the frame blocks 18. Then the process continues, with the next louver "layer", including a louver 14 and two male-to-female frame blocks 16 being placed on top of that "layer" and so on until the full height of the shutter is reached. Note that the outer edges of the frame blocks 16, 18 are still "squared off" at this point (See FIG. 4). It should also be noted that the frame blocks 16, 18 may be glued (or otherwise fastened such as by screws or ultrasonic welding, for instance) to each other and to the bottom rail 12 for enhanced structural integrity, if desired. The blocks 16 and louvers 14 are arranged parallel to each other and one above the other.

Figure 5:
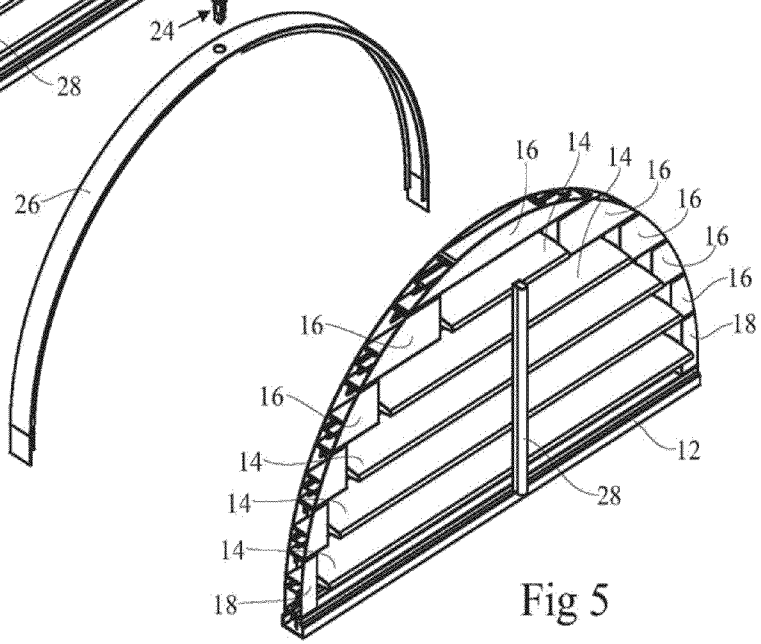
FIG. 5 is a perspective view, identical to FIG. 4, but showing the shutter after trimming the outer edges of the frame blocks to conform to the shape of the arched element.

The "squared off" assembly of FIG. 4 is then trimmed out to fit the window opening (or to fit the decorative frame 94 opening of FIGS. 36-39) as shown in FIG. 5, giving the outer surfaces 45 of the blocks 16, 18 and the top surface of the uppermost block 16 a curved shape. Then a cap extrusion 26 (also referred to as an arched element 26) is added, typically glued onto, or otherwise secured to, the outer surfaces of the frame blocks 16, 18 and the top surface 34 of the uppermost block 16. Finally, the frame locking plunger mechanisms 24 (See FIG. 3) are added. (These mechanisms are described in detail below.) A tilt bar 28 may also be added at this time. The tilt bar 28 is connected to all of the louvers 14 so all the louvers 14 can be raised and lowered at once by moving the tilt bar 28 up and down. The finished product is the shutter 10 shown in FIGS. 1 and 2.

Figure 35:
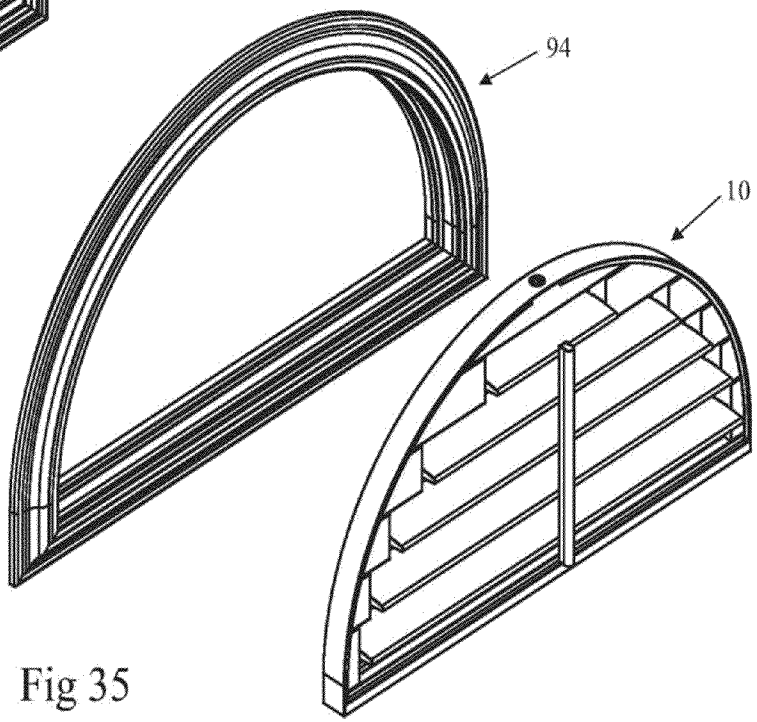
FIG. 35 is a partially exploded perspective view of the shutter and frame of FIG. 34.
Figure 34:
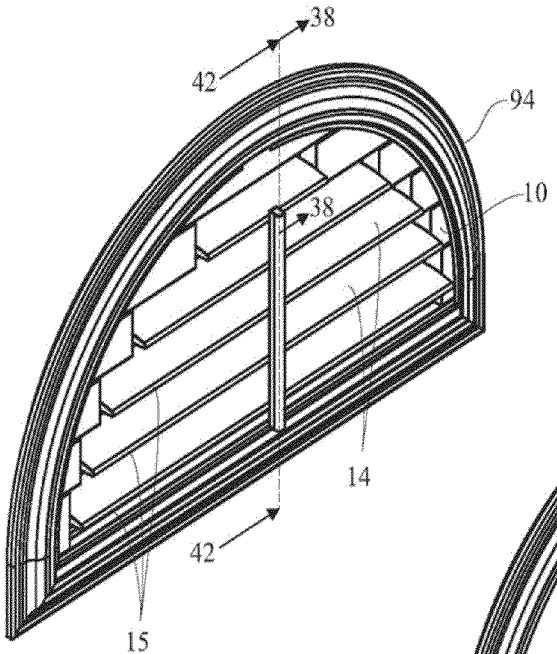
FIG. 34 is a perspective view of the shutter of FIG. 1 mounted into a frame.

The shutter 10 may then be mounted into a decorative frame 94 as shown in FIGS. 36-39. FIG. 35 shows the shutter 10 prior to installation into the decorative frame 94. FIG. 34 shows the same shutter 10 of FIG. 35 after it has been installed in the decorative frame 94, with the louvers 14 in the fully open configuration, with the first and second edges 15, 17 of each louver 14 lying on the same horizontal plane.

Figure 16:
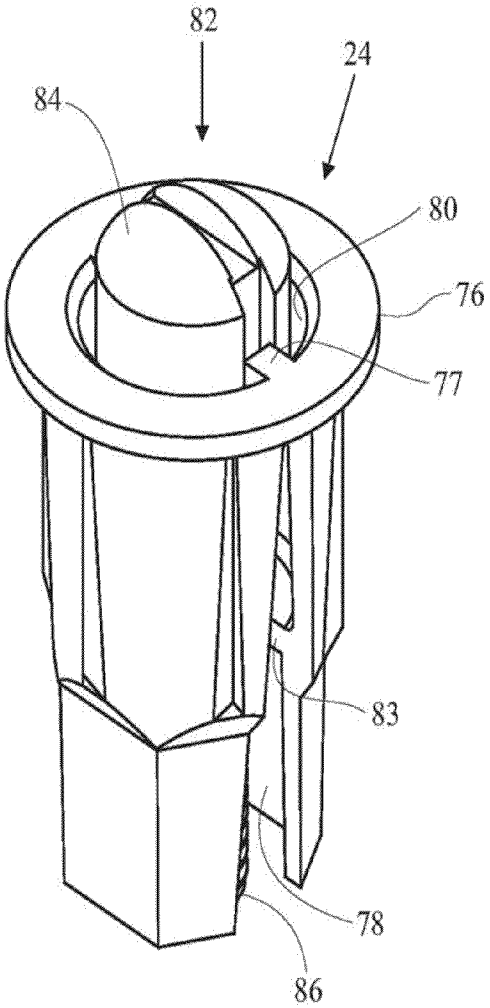
FIG. 16 is a perspective view of the assembled plunger and housing of FIGS. 14 and 15.
Figure 15:
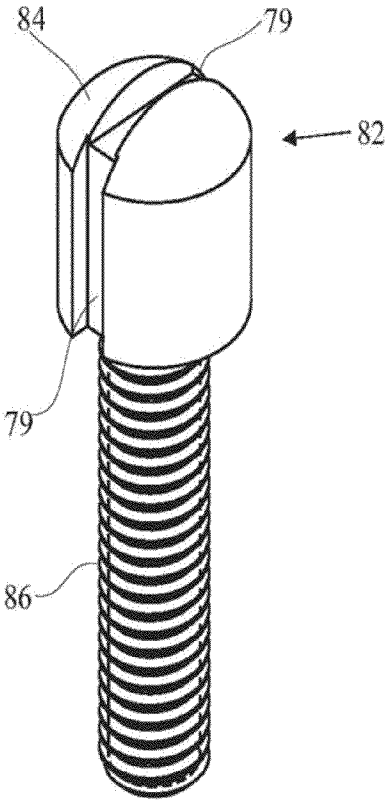
FIG. 15 is a perspective view of the plunger of FIG. 3.
Figure 38:
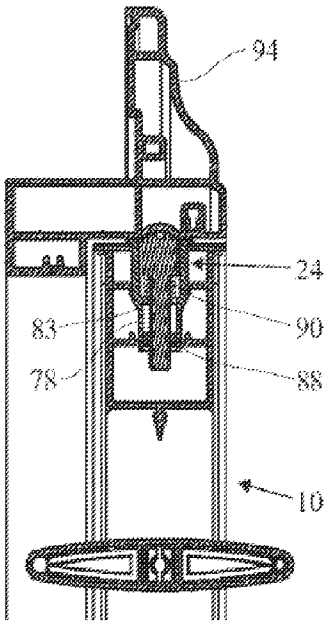
FIG. 38 is a section view along line 38-38 of FIG. 34 (with the tilt bar omitted for clarity)
Figure 37:
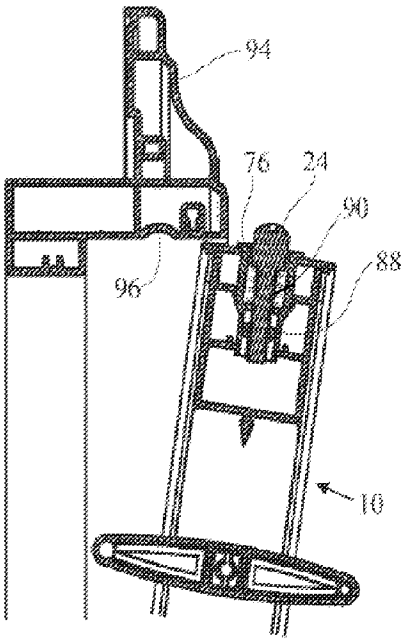
FIG. 37 is a section view along line 37-37 of FIG. 36.
Figure 36:
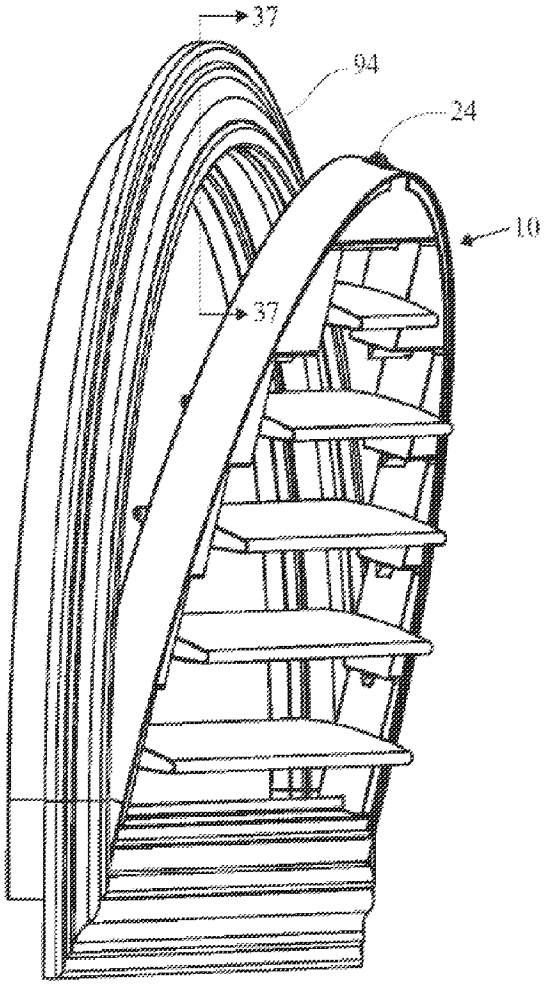
FIG. 36 depicts the partial installation of the shutter of FIG. 35 into its frame.
Figure 39A:
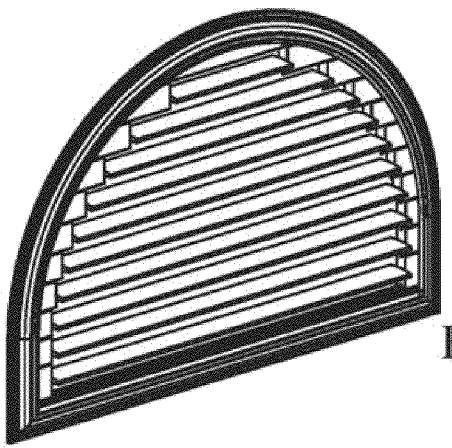
FIGS. 39A, 39B, 39C, and 39D are perspective views of various shutter geometries which may be made using the components described herein.
Figure 39B:
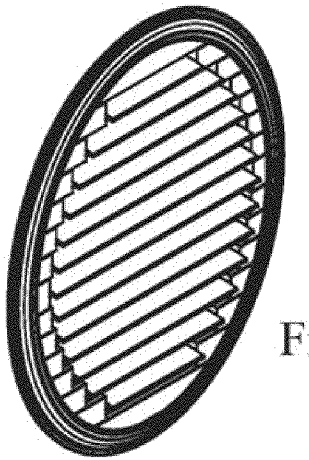
Figure 39C:
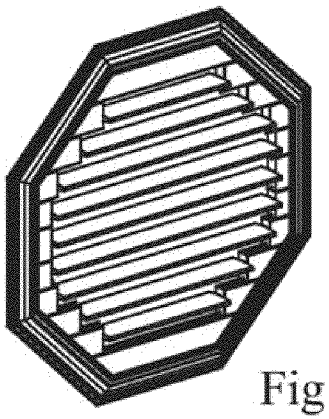
Figure 39D:
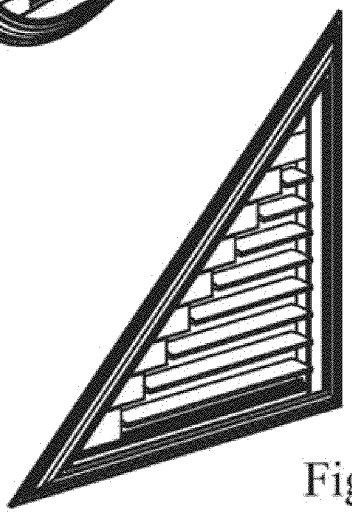

FIG. 16 depicts the frame locking plunger mechanism 24, which is used to install the shutter frame into the frame of the architectural opening as shown in FIGS. 36-38. The locking plunger mechanism 24 includes a plunger housing 76 and a plunger 82 received in the plunger housing 76. The plunger housing 76 can be seen in more detail in FIGS. 13 and 14 and defines a nut housing portion 78 in its lower portion, a spring housing portion 80 in its upper portion, and a web 83 (See FIG. 16) which has a central opening and defines the top of the nut housing portion 78 and the bottom of the spring housing portion 80. The plunger 82 can be seen in more detail in FIG. 15 and includes a rounded screw head 84 and a threaded portion 86.

As is best appreciated in FIGS. 37 and 38, the frame locking plunger mechanism 24 also includes a nut 88 and a spring 90. In order to assemble the plunger mechanism 24, the spring 90 is slipped upwardly over the threaded portion 86 of the plunger 82, which is then inserted downwardly into the top opening of the spring housing portion 80, with the threaded portion 86 extending through the central opening in the web 83 and into the nut housing portion 80. The nut 88 is inserted upwardly into the nut housing portion 78 of the housing 76, which has a profile that prevents the nut 88 from rotating relative to the housing 76. The plunger 82 is then rotated to thread the nut 88 onto the threaded portion 86 of the plunger 82. The spring 90 is trapped between the web 83 and the head 84 of the plunger 82, biasing the plunger 82 upwardly, and the plunger 82 is secured onto the housing 76, because the head 84 and the nut 88 are too large to pass through the central opening in the web 83. The frame locking plunger mechanism 24 is thus fully assembled and ready for use.

It should be noted that the plunger housing 76 defines two opposed, inwardly-projecting tabs 77, which are received in similarly opposed recesses 79 in the plunger head 84 to prevent the plunger 82 from rotating.

The frame locking plunger mechanism 24 is inserted into an opening on a part, such as on the uppermost frame block 16 of FIG. 3 (in this instance, the frame locking plunger mechanism 24 is also inserted through an opening 98 in the arched element 26 which helps secure the arched element 26 to the frame block 16). The frame locking plunger mechanism 24 is then adjusted by pushing the head 84 of the plunger 82 into the housing 24, compressing the spring 90 until the head 84 clears the tabs 77 (See FIG. 14) on the spring housing portion 80, and the plunger 82 is able to be screwed in or out, as required, relative to the nut 88. By screwing the plunger 82 in or out relative to the nut 88, the frame locking plunger mechanism 24 is adjusted so that the rounded screw head 84 projects outside of the housing 76 just enough to allow an interfering member, such as the decorative frame 94 (See FIGS. 36-38) to push the plunger 82 against the spring 90, causing the plunger 82 to retract momentarily into the housing 76 before it springs back out to engage a depression 96 (See FIG. 37) in the frame 94, releasably securing the shutter 10 to the decorative frame 94.

Figure 42:
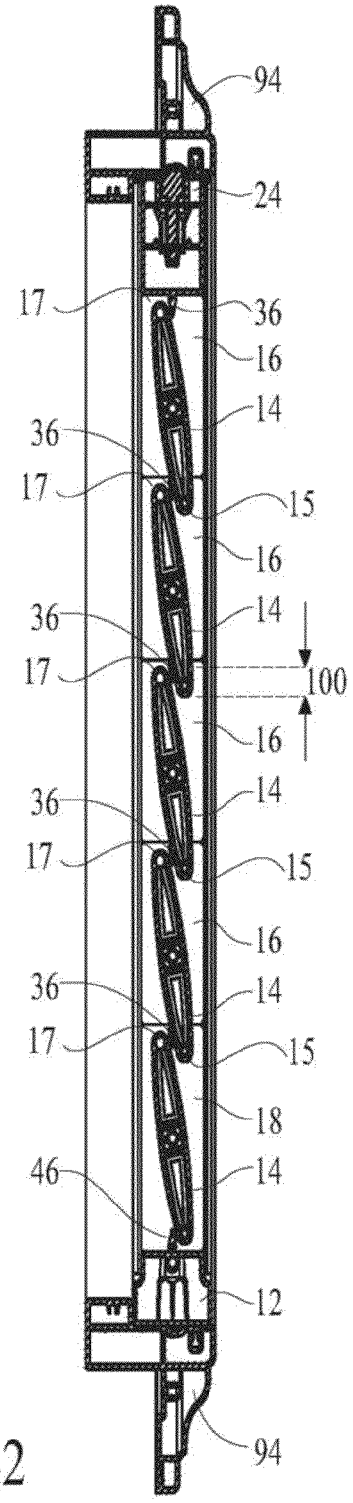
FIG. 42 is a section view along line 42-42 of FIG. 34, but with the louvers fully closed room-side down (with the tilt bar omitted for clarity)

FIG. 42 is a section view along line 42-42 of FIG. 34 (with the tilt bar removed for clarity), but with the louvers 14 in the fully closed, room-side down configuration, with the first edges 15 of the louvers 14 down, and the second edges 17 of the louvers 14 up. A portion of the second edge 17 which is up for each louver 14 abuts and overlaps the "V" shaped projections 36 in the frame blocks 16 extending downwardly from the layer that is directly above it, and the rest of the second edge 17 overlaps the first edge 15 of the louver 14 in the layer directly above it with a vertical overlap 100. There is very little gap between the adjacent louvers 14. The second edge 17 of the uppermost louver 14 abuts and overlaps the light stop 36 of the uppermost frame block 16. The first edge 15 of the bottom-most louver 14 abuts and overlaps the "V" shaped projection 46 extending upwardly from the bottom rail 12. These "V" shaped projections 36, 46 function as light stops to ensure a tight and full closure of the louvers 14 against the frame blocks 16, 18 and bottom rail 12 (which is also a type of frame block).

Figure 43:
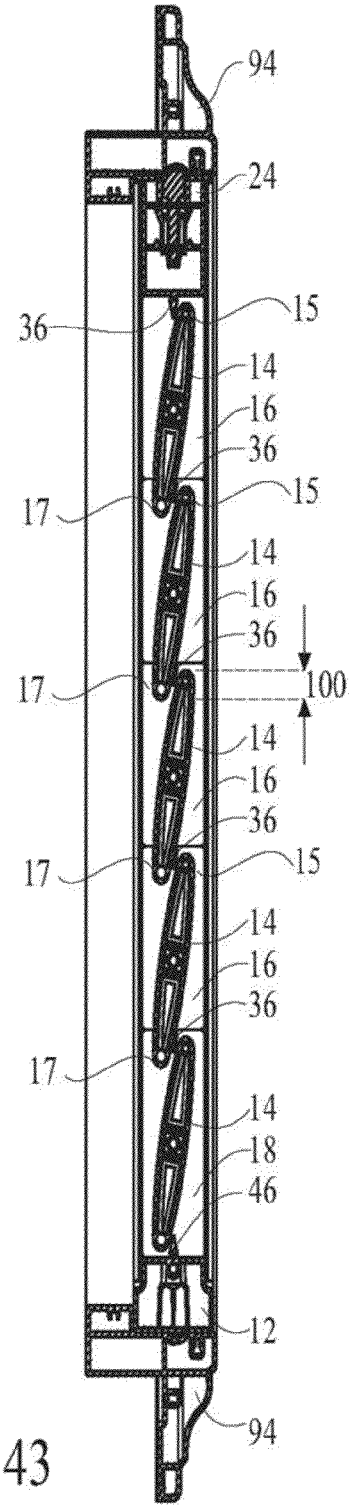
FIG. 43 is a section view identical to FIG. 42, but with the louvers fully closed room-side up.

FIG. 43 is identical to FIG. 42, but with the louvers 14 in the fully closed, room-side up configuration, with the first edges 15 of the louvers 14 up, and the second edges 17 of the louvers 14 down. A portion of the edge 15 which is up for each of the louvers 14 abuts and overlaps the "V" shaped projections 36 extending downwardly from the frame blocks 16 directly above it, and the rest of the edge 15 which is up overlaps the second edge 17 of the louver 14 directly above it with a vertical overlap 100. Again, there is very little gap between the louvers 14. The lowermost louver 14 abuts and overlaps the "V" shaped projection 46 extending upwardly from the bottom rail 12, ensuring a tight and full closure of the louvers 14 against the frame blocks 16, 18 and bottom rail 20.

It should be noted that the terms "up" and "down", "left" and "right", and even "horizontal" and "vertical" are relative terms only and are referenced to the figures in the specification. For example, if a shutter is rotated 90 degrees, what was up will then be to one side and what was vertical will become horizontal. With respect to the frame of reference of the figures in the specification, the louvers 14 are in the fully open position when the first and second edges 15, 17 lie in the same horizontal plane. As may be appreciated from this definition and from the views shown in FIGS. 42 and 43, the louvers 14 pivot over substantially the same angular distance from the fully open, horizontal position to each of the completely closed positions, and they close equally well in both directions.

Figure 52:
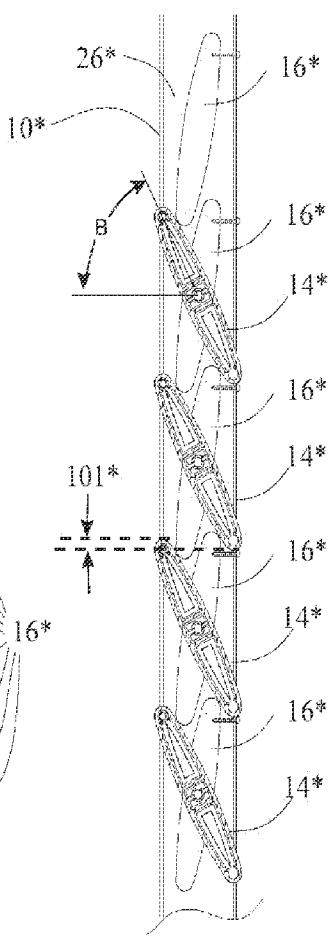
Fig 52 PRIOR ART
FIG. 52 is the same view as FIG. 51, but showing the shutter in the closed position, room side up.
Figure 50:
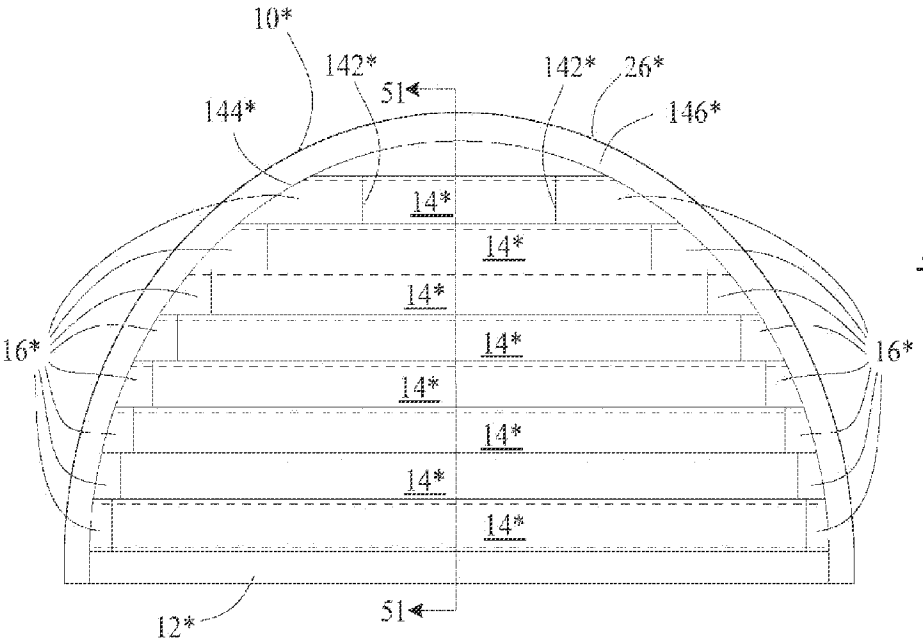
Fig 50 PRIOR ART
FIG. 50 is a front view (room side front view) of a prior art arched shutter.
Figure 51:
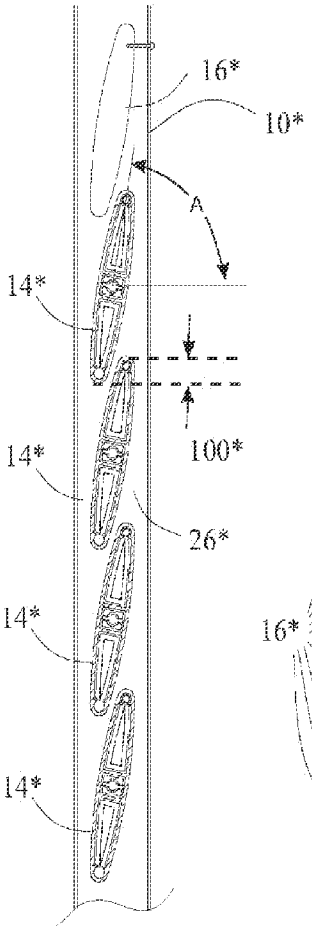
Fig 51 PRIOR ART
FIG. 51 is a view along line 51-51 of the shutter of FIG. 50, showing the shutter in the fully closed position, room side down.

FIGS. 50, 51, and 52 show the shutter described and taught in Canadian Patent Application No. 2 487 556 "Marocco". The Marocco shutter 10* (See FIG. 50) includes an arched element 26*, a bottom rail 12*, and a plurality of louvers 14* pivotably mounted onto frame blocks 16* for rotation about a horizontal axis. In this case, the frame blocks 16* are extensions of the louvers 14*, and have the same profile as the louvers 14*. In fact, the manufacturing of the frame blocks 16* involves taking a louver 14* which is longer than required and "squaring off" both ends by cutting off the ends at the lines 142* (See the top louver 14* in FIG. 50). The portion between these two cut lines 142* becomes the louver 14* and the end pieces become frame blocks 16*. The outer edges of these frame blocks 16* are cut along the arcuate paths 144*, 146* to conform to the arched shape of the arched element 26*.

In this case, the frame blocks 16* are not stacked on top of each other, with the bottom surface of a first block resting on the top surface of the next lower second block. Instead, the frame blocks 16* are arranged so that the bottom surface of a first block 16* lies in front of and below the top surface of the next lower second block 16*, as shown best in FIG. 52.

FIG. 51 depicts the Marocco shutter 10* in the fully closed, room-side down position. In this position, the frame blocks 16* (except for the topmost frame block 16*) are hidden behind the louvers 14* since the frame blocks 16* and the louvers 14* have the identical profile and are lined up perfectly (that is, they are both in the same room-side down orientation). In this position, the louvers 14* have pivoted an angle "A" equal to approximately 80 degrees from the fully open position, in which both edges of the louvers 14* were in the same horizontal plane. The top of each louver 14* abuts the bottom of the louver 14* above it and the bottom of the frame blocks 16* above it and has the same vertical overlap 100* with both the louver and the frame block above it. Compare this with a similar view in FIG. 43 of the shutter 10. In FIG. 43, the frame blocks 16 are clearly visible, stacked on top of each other.

FIG. 52 depicts the Marocco shutter 10* in the fully closed, room-side up position. In this position, the frame blocks 16* (including the topmost frame block 16*) are clearly visible behind the louvers 14*, since the frame blocks 16* remain fixed to the arched element 26* and do not pivot with the louvers 14*. In this position, the louvers 14* have pivoted an angle "B" equal to approximately 60 degrees from the fully open position, before abutting the frame blocks 16* directly above them, which prevents them from further rotation. This is a substantially smaller angle of rotation than the angle of rotation to reach the fully closed room-side down position of FIG. 51. In this closed room-side up position, each louver 14* overlaps the bottom edge of the louver 14* above it with a vertical overlap 101* which is a substantially smaller vertical overlap than the overlap 100* of the room-side down closed position. Compare this with a similar view in FIG. 42 of the shutter 10, where there is the same vertical overlap 100 between adjacent louvers in both closed positions.

The angle of rotation of the louvers 14 shown in FIGS. 42 and 43 is substantially the same from the fully open position to each of the completely closed positions (an angle of approximately eighty degrees from the fully open position in each direction), because the frame blocks 16 are stacked directly on top of each other rather than one lying behind the other, which permits the light stop projections 36, which project downwardly from the cantilevered portions of the blocks 16 and stop the rotation of the louvers 14, to be positioned so as to permit the same angular rotation of the louvers in both directions.

Other Embodiments of a Shutter

Figures 18, 19:
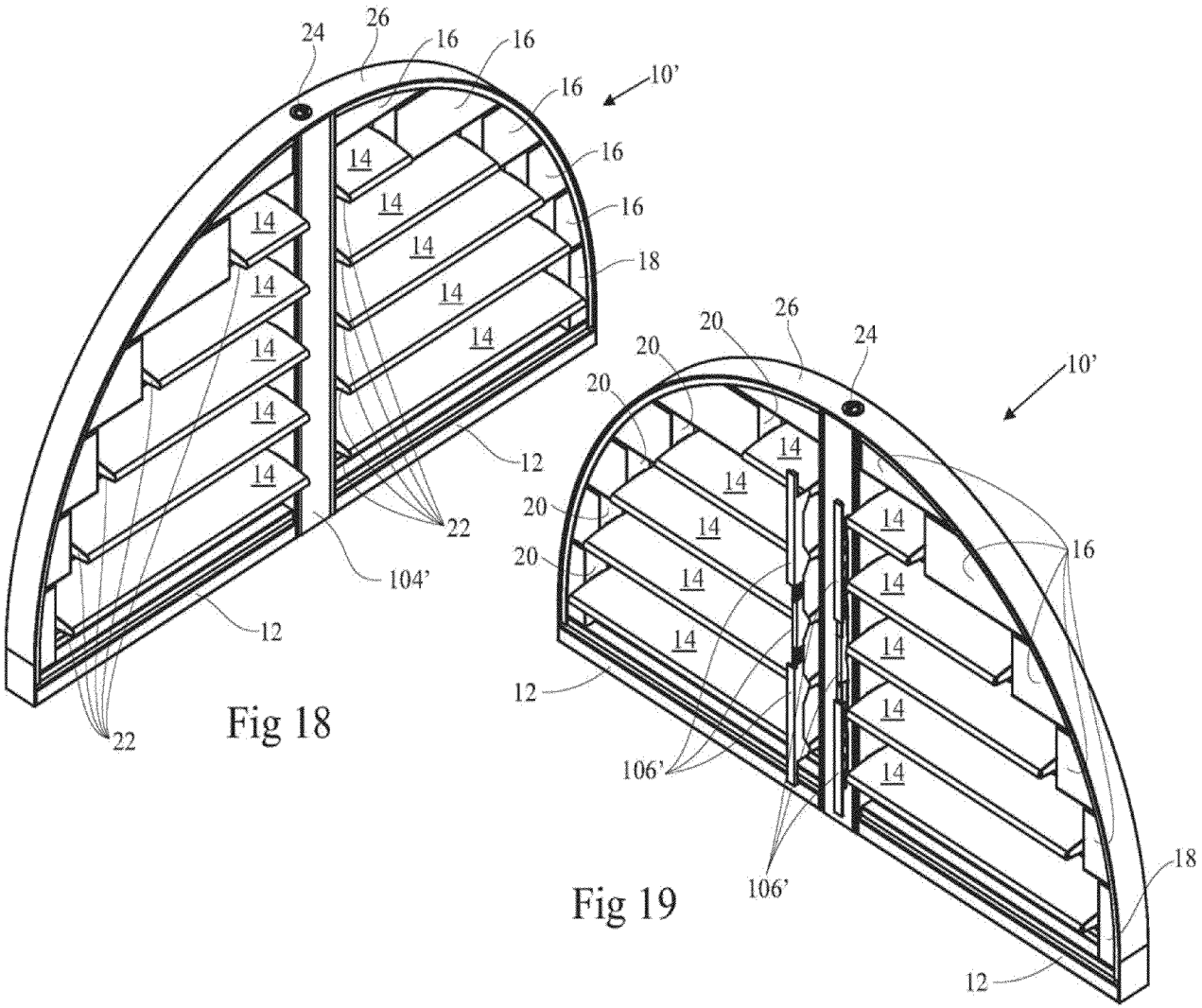
FIG. 18 is a room-side perspective view of another embodiment of a shutter made in accordance with the present invention.
FIG. 19 is a wall-side perspective view of the shutter of FIG. 18.
Figure 20:
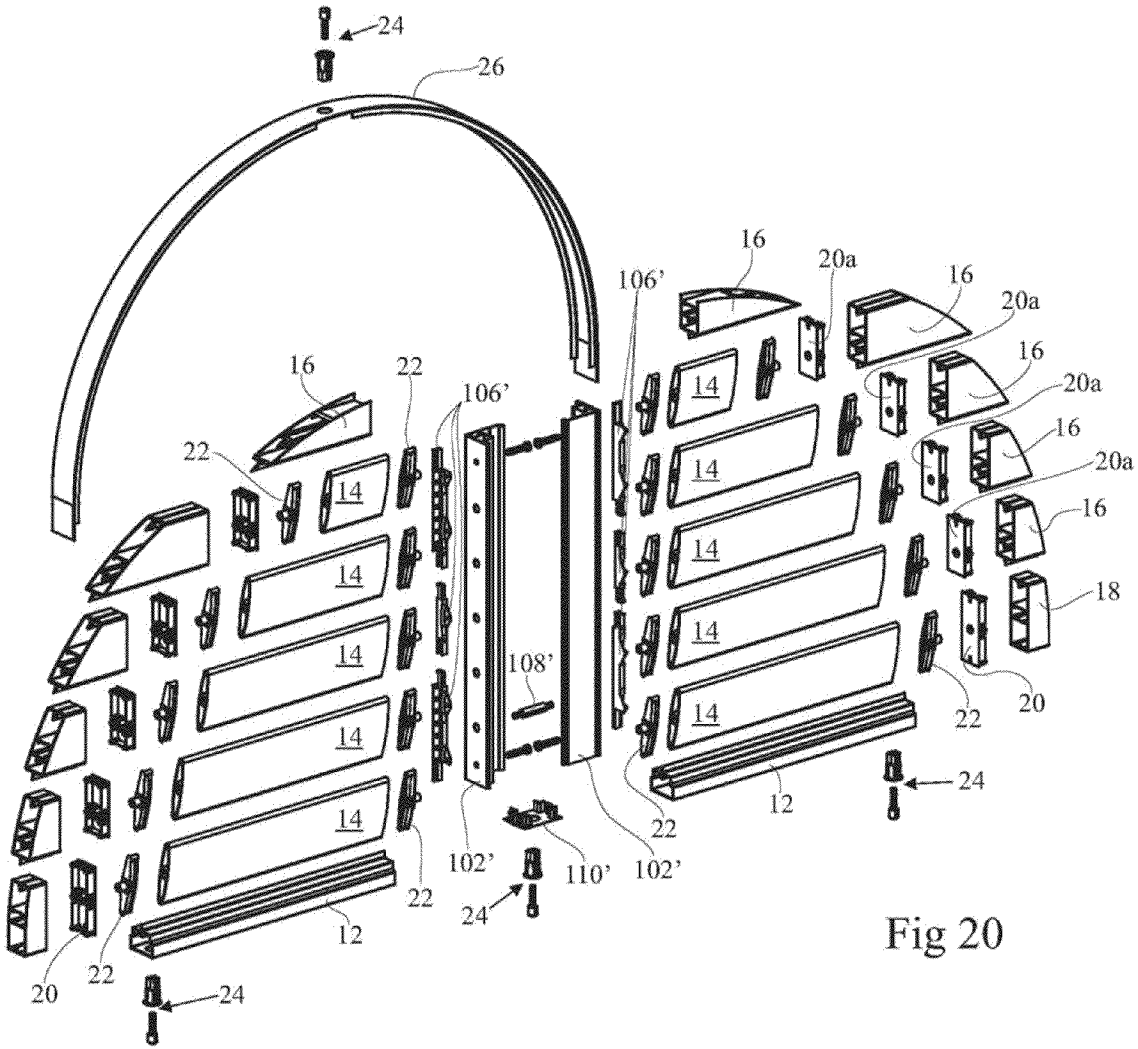
FIG. 20 is an exploded, perspective view of the shutter of FIG. 18.

FIG. 18 is a room-side perspective view of another shutter 10'. FIG. 19 is a wall-side view of the shutter 10' of FIG. 18, and FIG. 20 is an exploded, perspective view of the shutter 10' of FIG. 18. This shutter 10' is very similar to the previous shutter 10, but it includes vertical elements 102' that form a vertical member 104', and the louvers 14 are arranged into linearly-aligned pairs of left and right louvers. The bottom-most pair of linearly-aligned louvers 14 is coupled directly together by a coupler shaft 108', while the other louvers 14 are caused to move together by means of linkages 106'. In order to simplify the description, the same item numbers are used for the same components that are present in the previous shutter 10.

As best appreciated in FIG. 20, this shutter 10' includes two bottom rails 12, pivotable louvers 14, male-to-female frame blocks 16, female-to-female bottom-most frame blocks 18, frame end caps 20, 20A, louver end caps 22, frame locking plungers 24, an arched element (or end cap) 26, vertical elements 102' (two required to form the vertical member 104' of FIG. 18), clear-view louver linkages 106', a coupling shaft 108', and a bottom vertical support 110', as described in more detail below.

Figure 21:
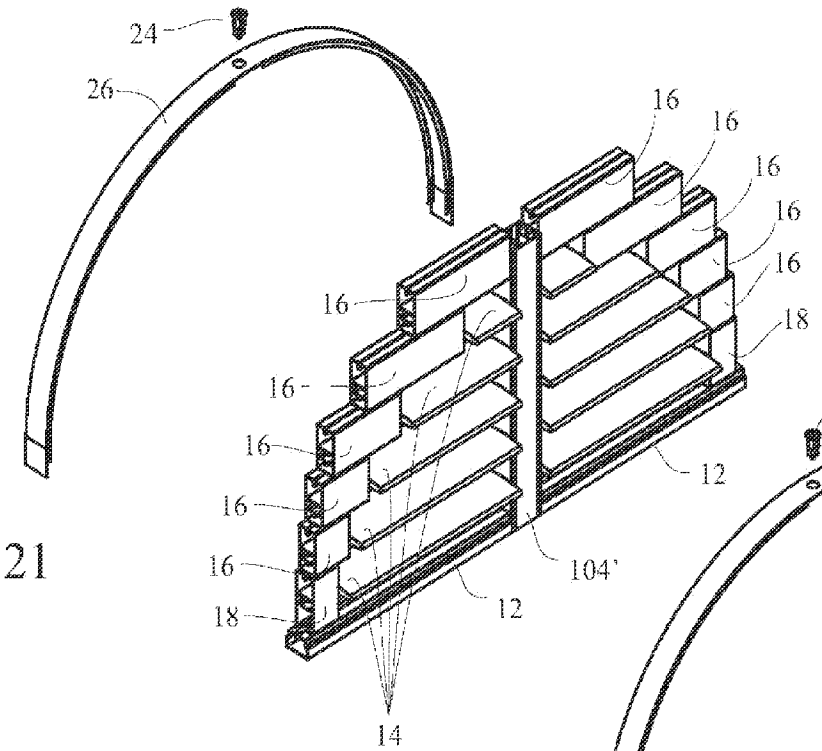
FIG. 21 is a partially exploded, perspective view of the shutter of FIG. 18, showing an intermediate step of production just prior to trimming the frame blocks to conform to the shape of the arched element.
Figure 22:
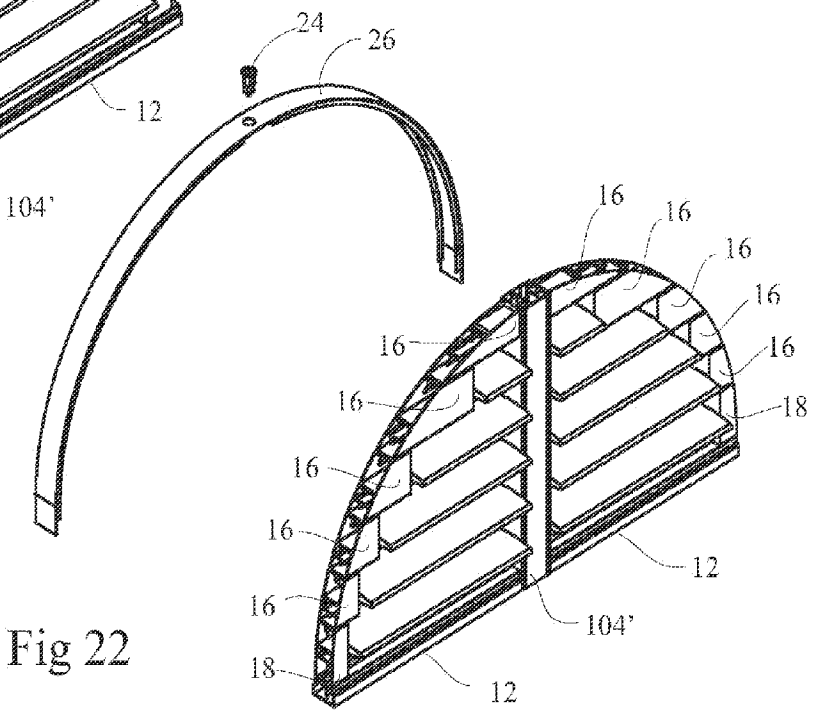
FIG. 22 is a perspective view, identical to FIG. 21, but showing the shutter after trimming the outer edges of the frame blocks to conform to the shape of the arched element.
Figure 24:
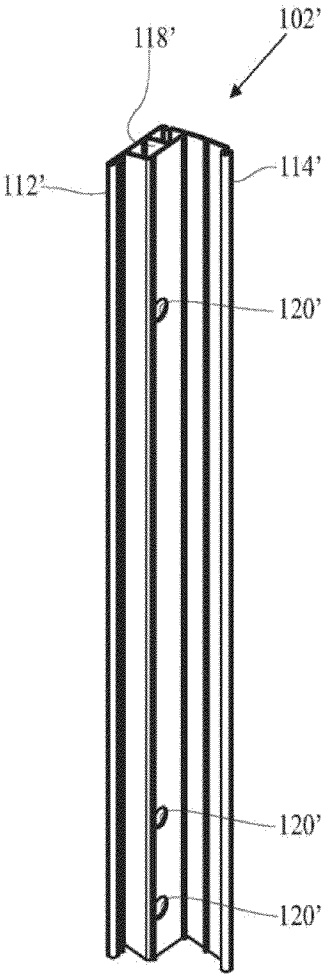
FIG. 24 is perspective view of the inside of the vertical element of FIG. 23.
Figure 23:
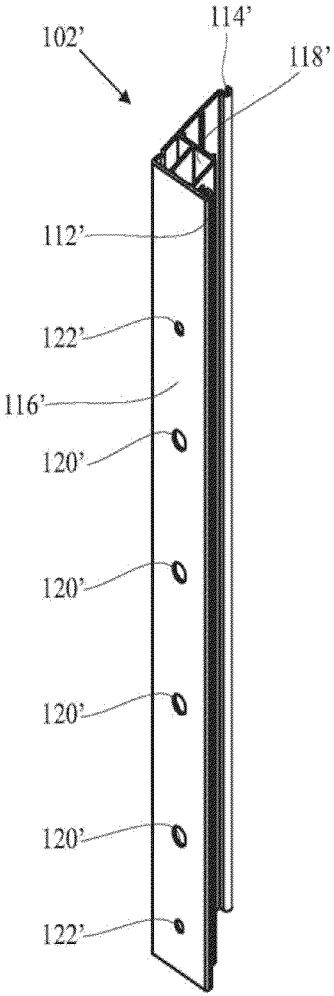
FIG. 23 is a perspective view of the outside of one of the vertical elements (two required) which form the vertical member of FIG. 18.

Referring to FIGS. 18-20, the vertical member 104' is made from two identical vertical elements 102' (See FIG. 20) that are connected together as shown in FIGS. 21 and 22. Referring now to FIGS. 23 and 24, the vertical element 102' is an elongated, plastic (PVC) extrusion having a substantially "L-shaped" cross-section and defining a first, inward-facing hooked edge 112', and a second, outward-facing hooked edge 114'. A first leg 116' of the vertical element 102' defines a rectangular cavity 118' extending the full length of the vertical element 102'. This first leg 116' also defines a plurality of vertically-aligned, spaced-apart openings. Some of these openings 120' are larger and some openings 122' are smaller. There are also some larger openings 120' in the far wall of the cavity 118', as may be appreciated in FIG. 24. The purpose of these openings 120', 122' will be explained later with respect to attachment screws and coupling shafts.

In FIG. 24, the vertical element 102' has been rotated 90 degrees about its longitudinal vertical axis from its position as depicted in FIG. 23. If the vertical element 102' is rotated an additional 90 degrees, for a total of 180 degrees of rotation, then two vertical elements 102' can slide lengthwise into each other to form the vertical member 104' shown in FIGS. 18, 19, and 27. The final assembly is best illustrated in FIG. 30, showing how the first, inward-facing hooked edge 112' of each L-shaped vertical element 102' engages and locks into the second, outward-facing hooked edge 114' of the other L-shaped vertical element 102' to form a rectangular vertical member 104'.

Figure 27:
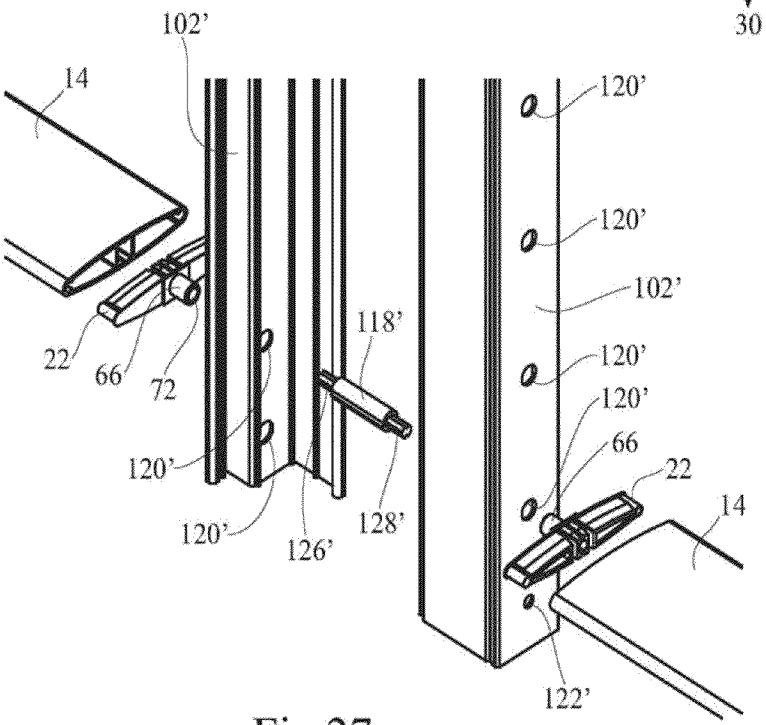
FIG. 27 is a broken-away, exploded, perspective view showing the assembly of louvers to the vertical member of the shutter of FIG. 20 (with the louver linkages omitted for clarity)
Figure 29:
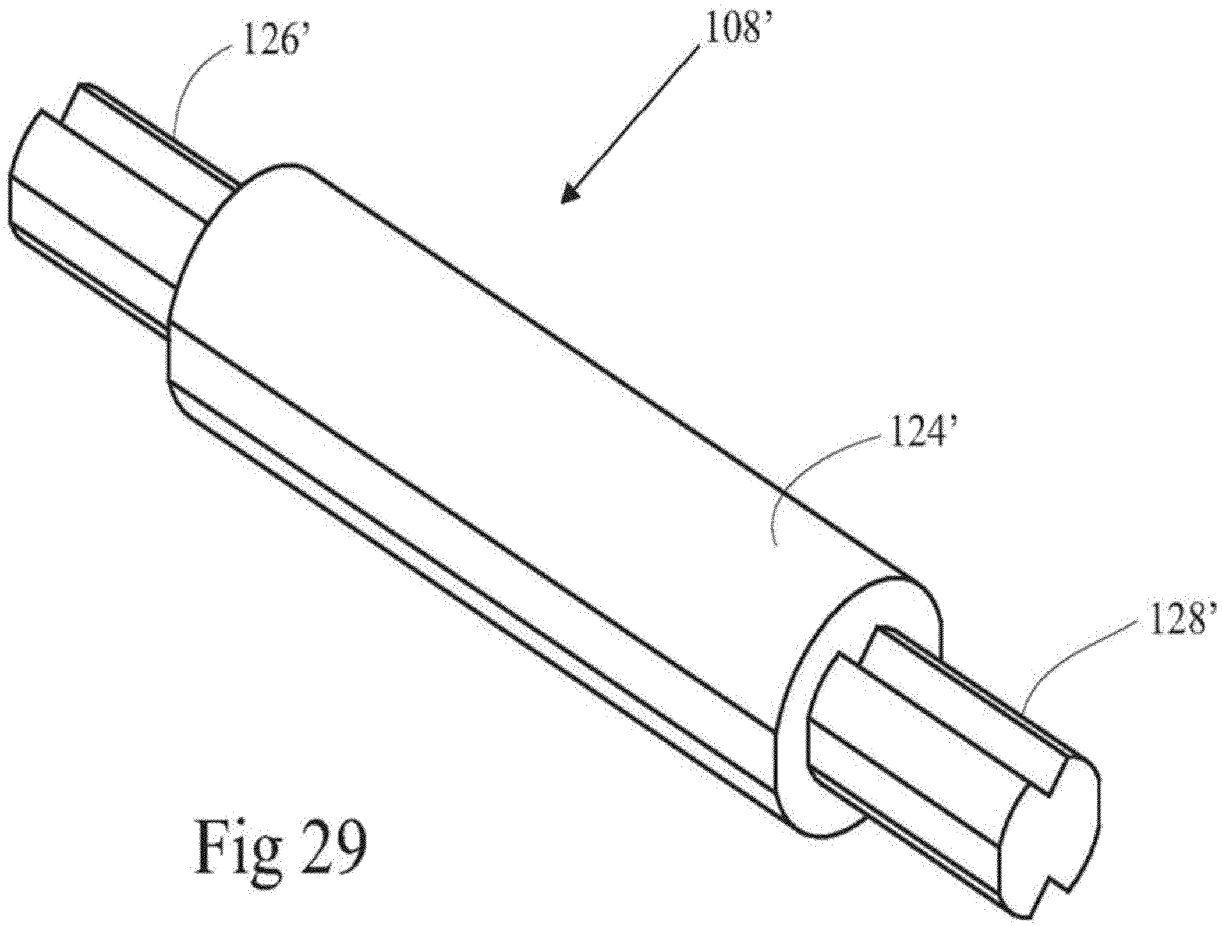
FIG. 29 is a perspective view of the coupling shaft of FIG. 27.
Figure 30:
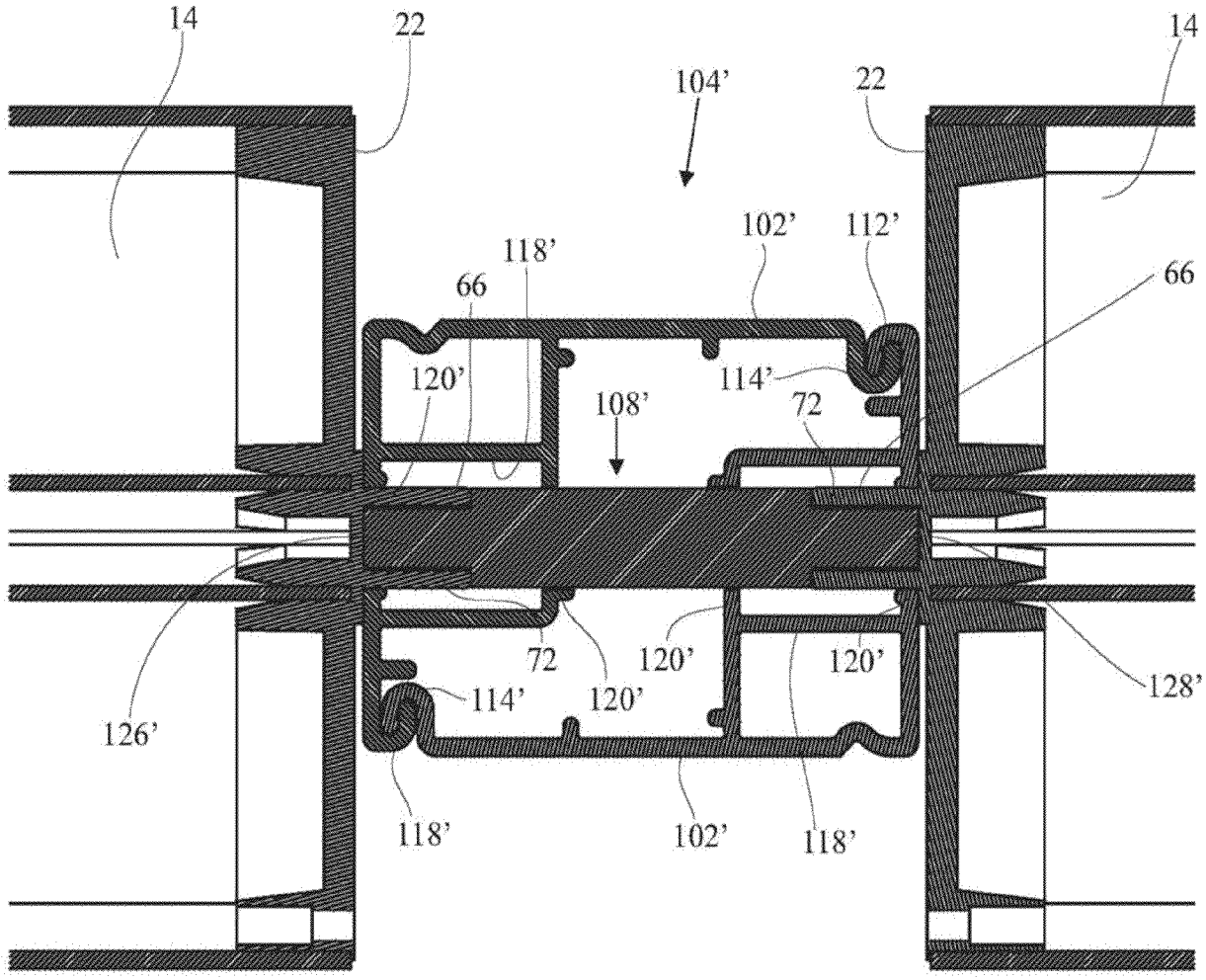
FIG. 30 is a section view along line 30-30 of FIG. 28.

FIG. 29 depicts the coupling shaft 108' of FIGS. 20, 27, and 30. The coupling shaft 108' is an elongated shaft with a substantially cylindrical shape for the main body 124'. Shaft extensions 126', 128' project from both ends of the main body 124'. These shaft extensions 126', 128' each have a non-circular, cross-sectional profile designed to match the hollow cavity 72 (See FIG. 11) of the louver end caps 22.

The outer diameter of the main body 124' of the coupling shaft 108' is substantially the same as that of the pivot shaft 66 of the louver end caps 22 (as can be appreciated in FIG. 30), and this diameter is slightly smaller than the size of the large openings 120' in the vertical elements 102'. This allows the assembly depicted in FIGS. 27 and 28 (including the coupling shaft 108', the louvers 14, and the louver end caps 22) to be assembled after the two vertical elements 102' have been assembled to form the vertical member 104'.

Figure 32:
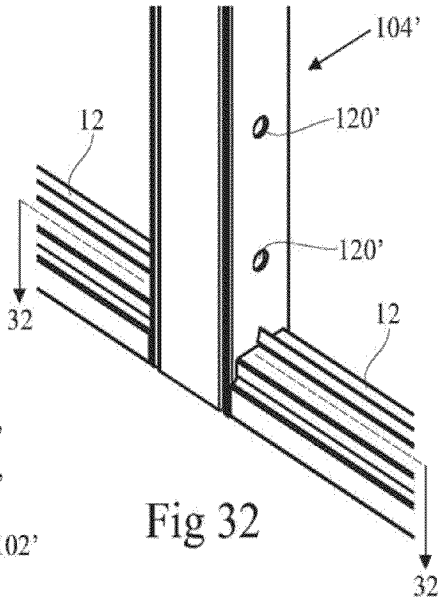
FIG. 32 is a perspective view of the assembled components of FIG. 31.
Figure 31:
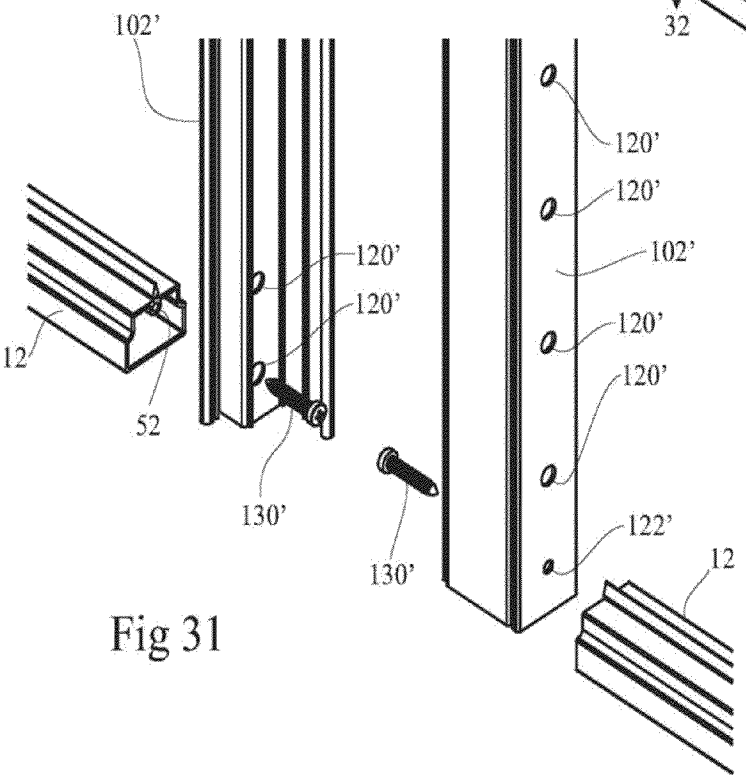
FIG. 31 is a broken-away, exploded perspective view of the assembly of the bottom rails to the vertical member of the shutter of FIG. 20.
Figure 33:
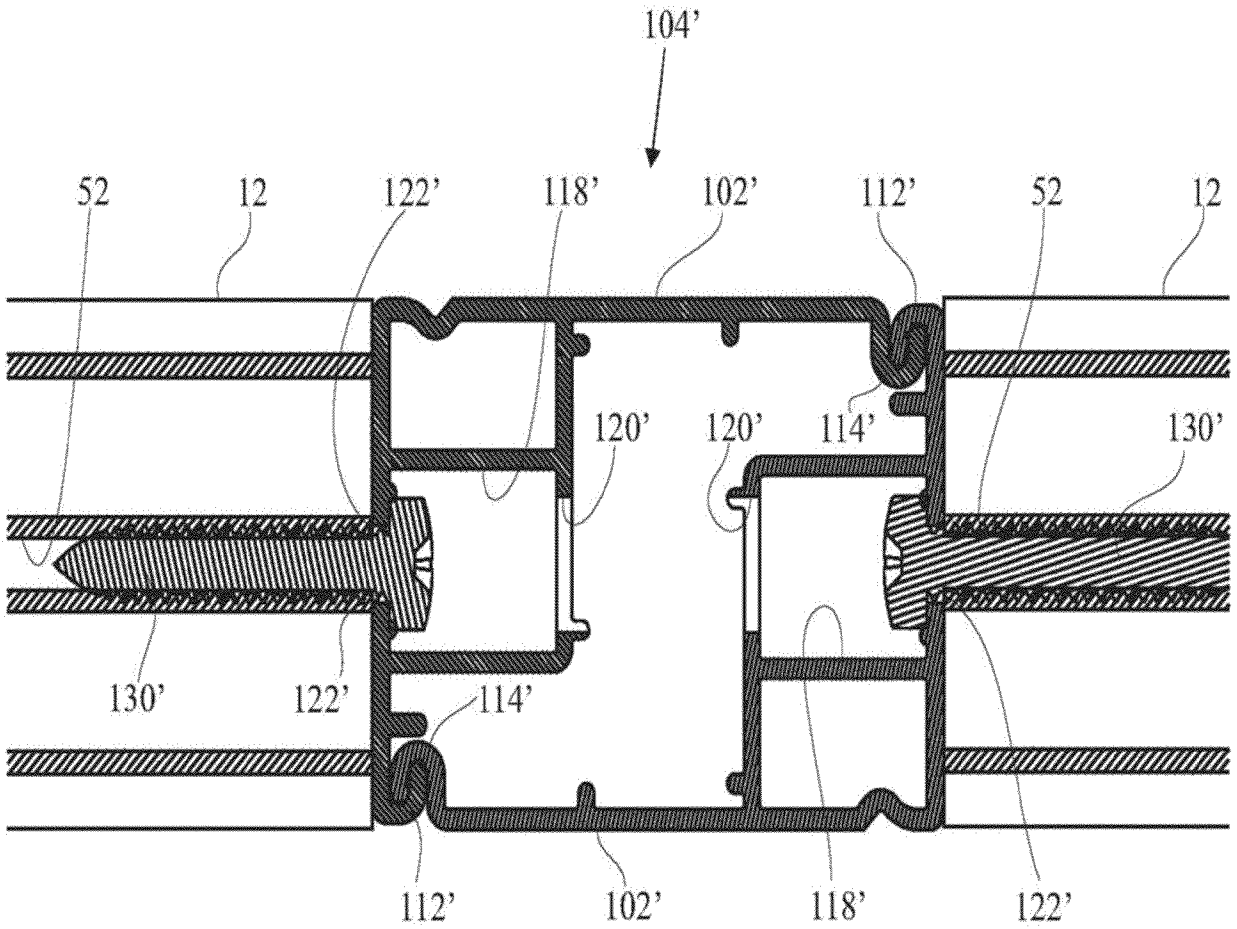
FIG. 33 is a section view along line 33-33 of FIG. 32.

Assembly:

FIGS. 31, 32, and 33 depict the assembly of the vertical member 104' to the bottom rails 12. Prior to sliding the vertical elements 102' together to form the vertical member 104', the bottom rails 12 are attached to the vertical elements 102' by inserting a screw 130' through the bottommost larger opening 120' in the far wall of the cavity 118', and through the aligned smaller opening 122' in the first leg of the vertical element 102', and threading the screw 130' into the screw runner 52 of the respective bottom rail 12. Once the vertical elements 102' are secured to their respective bottom rails 12, the vertical elements 102' are slid into each other to form the vertical member 104' as shown in FIGS. 32 and 33.

Figure 26:
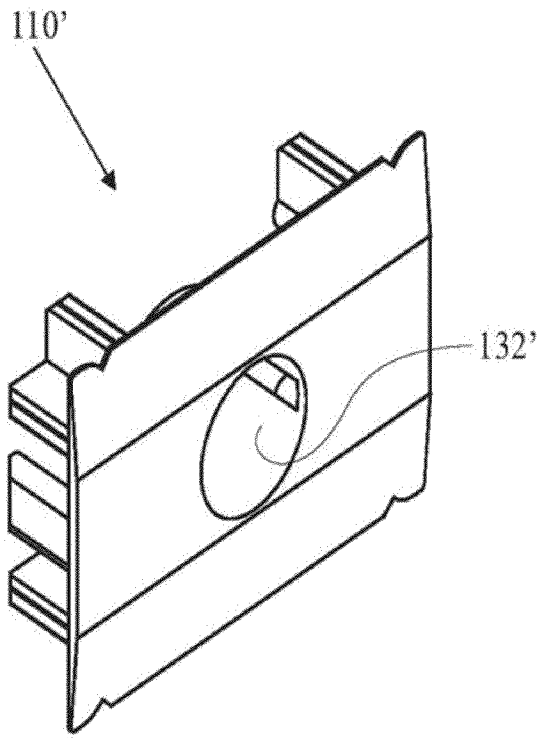
FIG. 26 is a perspective view of the outside of the bottom vertical support of FIG. 25.
Figure 25:
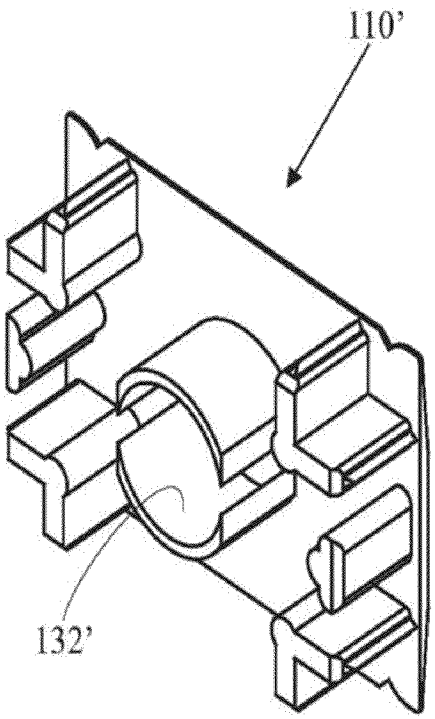
FIG. 25 is a perspective view of the inside of the bottom vertical support of FIG. 20.
Figure 28:
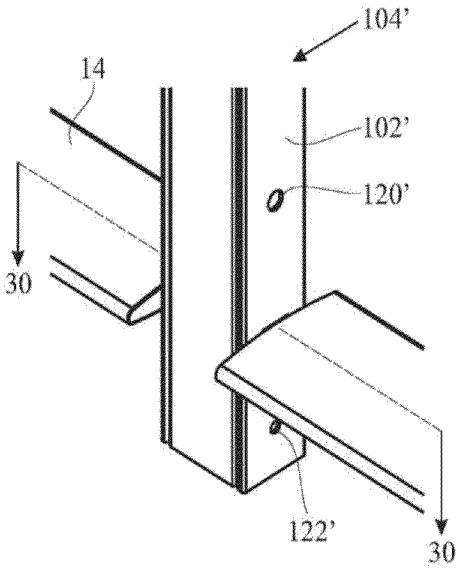
FIG. 28 is a perspective view of the assembled components of FIG. 27.

FIGS. 25 and 26 depict the bottom vertical support 110' of FIG. 20. This bottom vertical support 110' is designed to snap into the bottom of the vertical member 104', and provides an opening 132' for inserting a frame locking plunger 24 as shown in FIG. 20.

Once the bottom rails 12 have been secured to the vertical elements 102' and those vertical elements 102' have been assembled together to form the vertical member 104' as described above, the bottom vertical support 110' is snapped into the bottom of the vertical member 104'.

Next, the first "layer" of louvers 14 is installed. The louver end caps 22 are assembled onto the left and right louvers 14 that are to be linearly aligned and coupled together. (The louvers have been pre-cut to the desired length). One end 126' of the coupling shaft 108' is inserted into the hollow cavity 72 of the louver end cap 22 of the left louver 14, and the other end 128' of that coupling shaft 108' is then inserted through the lowest of the larger openings 120' of the assembled vertical member 104', and through the cavities 118' of the vertical elements 102', as depicted in FIG. 30. Finally, the pivot shaft 66 of the louver end cap 22 of the right louver 14 is inserted through the corresponding opposite opening 120' of the vertical member 104' until its cavity 72 receives the other end 128' of the coupling shaft 108'. Now, when either one of the left and right coupled louvers 14 is tilted, the other louver 14 on the other side of the vertical member 104' will also rotate with it, connected by the coupling shaft 108'.

The free ends of the coupled louvers 14 are then assembled onto the frame blocks 18, and the frame blocks 18 are slid together (or pressed downwardly, if the design allows) onto the bottom rail 12 as described with respect to the first embodiment. This completes the bottommost "layer" of louvers 14.

Now, the assembly of the rest of the shutter 10' may proceed in a manner similar to the assembly of the first embodiment. Each louver 14 is assembled with its respective "squared off" frame block 16 at one end as shown in FIG. 21. The shaft 66 of the end cap 22 at the other end of the louver 14 is inserted into its respective opening 120' in the vertical member, and the respective frame block 16 is pressed downwardly onto the frame block 16 or 18 below it. Once assembled as shown in FIG. 21, the frame blocks 16,18 are trimmed out to fit the window opening (or to fit the opening of the decorative frame 94 of FIGS. 36-39) as shown in FIG. 22, and a cap extrusion 26 is added, typically glued onto the frame blocks 16, 18. Finally the frame locking plunger mechanisms 24 (See FIG. 20) are added. A tilt bar (not shown) may also be added at this time.

Figure 44:
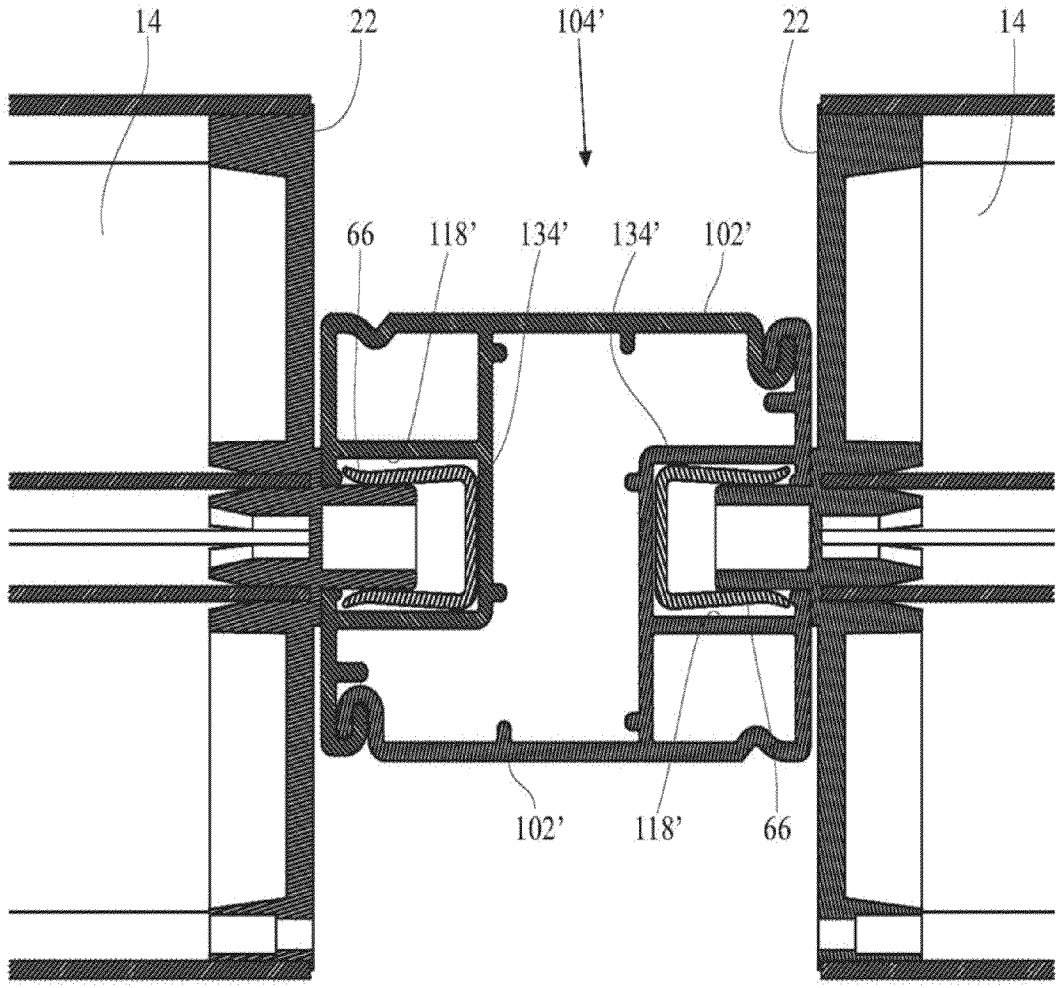
FIG. 44 is a partially broken away, section view, similar to that of FIG. 30, but for the louvers located above the lowermost louver and incorporating a clamp brake.

FIG. 44 depicts substantially "U" shaped clamp brakes 134' which may be incorporated into the cavities 118' of the vertical member 104'. The brake 134' is described in U.S. Pat. No. 5,191,735 "Ross" issued Mar. 9, 1993, which is hereby incorporated herein by reference (See Ross '735, FIG. 2, item 15). The clamp brake 134' is preferably a vinyl strip which slides into the cavity 118' as shown in FIG. 44. As a louver 14 is installed, the pivot shaft 66 of the louver end cap 22 extends through one of the larger openings 120' of the vertical member 104' and into the cavity 118', where it is caught between the arms of the clamp brake 134'. The clamp brake 134' provides additional resistance to the pivoting motion of the louvers 14 such that, when the operator releases the louvers, they remain tilted in the desired position. If it is desired to use a clamp brake 134', it may be installed in the vertical member 104' either before the louvers 14 are mounted onto the vertical member 104', or after the louvers have been installed but before the arched element 26 is attached to the shutter 10'.

FIG. 19 shows the clear-view linkages 106', which are well known in the industry, adjacent to each side of the vertical member 104'. These linkages 106' pivotably connect to the louver end caps 22 at the openings 74 (See FIGS. 11 and 12) of each of the louver end caps 22 adjacent the vertical member 104', such that, when one of the louvers 14 is pivoted (tilted), all of the louvers interconnected by the linkages 106' pivot in unison. Since the bottommost louvers 14 on either side of the vertical member 104' are also interconnected by the coupling shaft 108' (See FIGS. 20 and 27), if any one louver 14 is tilted, the coupling shaft 108' and the clear-view linkages 106' work together to ensure that all louvers 14 tilt in unison.

Figure 40A:
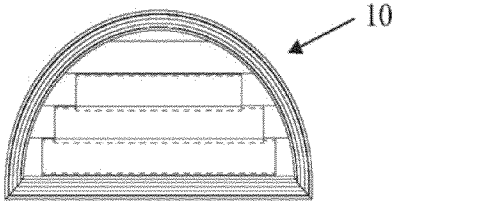
FIGS. 40A, 40B, and 40C depict shutters made in accordance with the present invention to illustrate the fact that the shutters may have none, one, or more vertical members as desired, or as required by the size of the shutter.
Figure 40B:
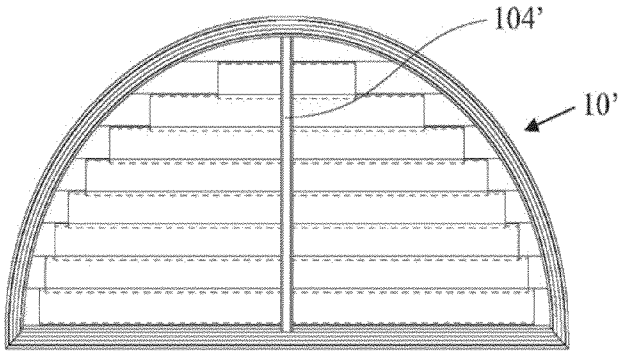
Figure 40C:
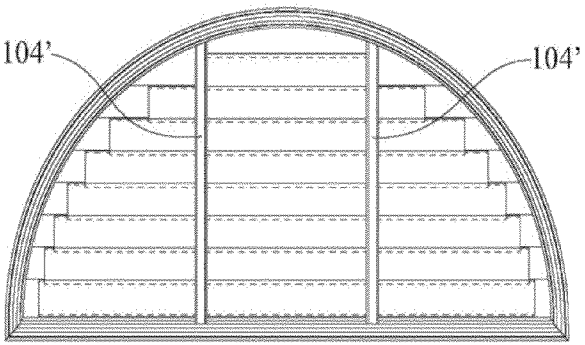

FIGS. 40A, 40B, and 40C show that the shutter may have no vertical members, a single vertical member 104', or more than one vertical member 104', depending on the size of the shutter and on the desired aesthetic results.

Figures 41A, 41B, 41C:
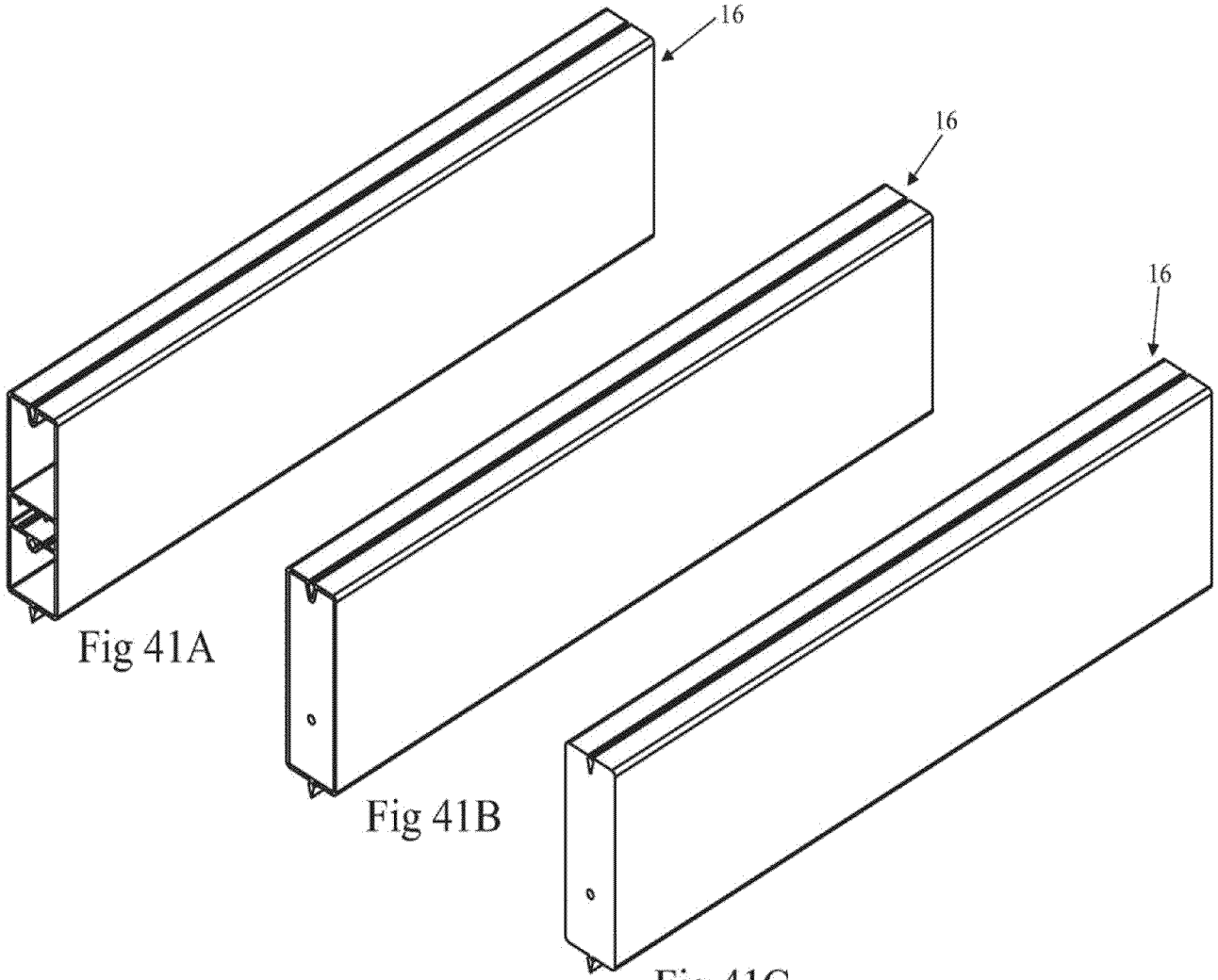
FIGS. 41A, 41B, and 41C illustrate different materials and methods of construction which may be utilized for the different components of the shutter. The component illustrated is the male-to-female frame block, shown in FIG. 41A, which is made as a hollow extrusion, but it also could be made as a coated solid or a foamed substrate as shown in FIG. 41B, or as a solid, such as a wood or foamed polymer profile, as shown in FIG. 41C.

FIG. 41A depicts the male-to-female frame block 16 of FIG. 6 as a hollow extrusion which is preferably made from a plastic, such as PVC, but may also be from some other material such as aluminum. FIG. 41B depicts essentially the same frame block 16, but made from another material, such as a coated solid or a foamed substrate. FIG. 41C also depicts the same frame block 16, but made from yet another material, such as a solid such as wood or a foamed polymer. Many of the components described above may be made from any one, or from a combination of, the above materials.

Figure 45:
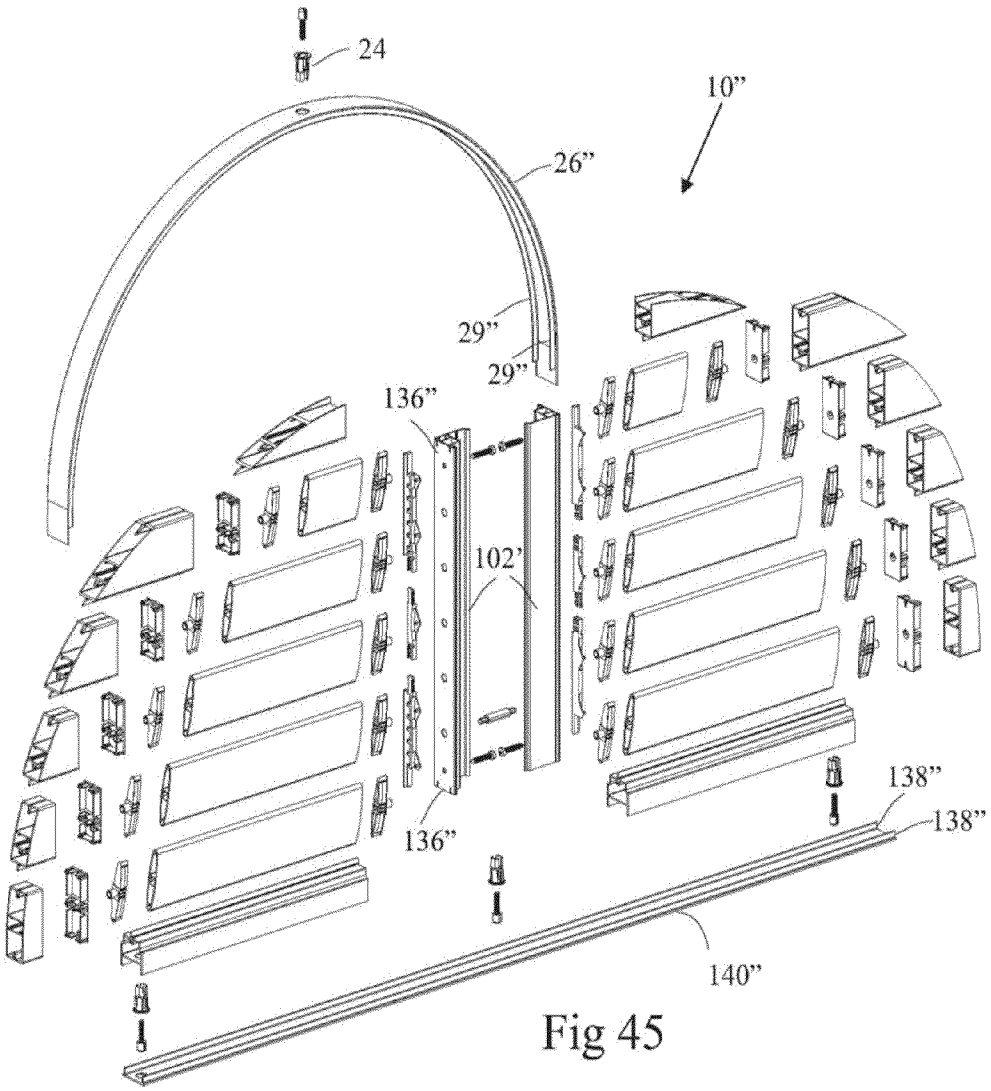
FIG. 45 is an exploded perspective view of another embodiment of a shutter.
Figure 46:
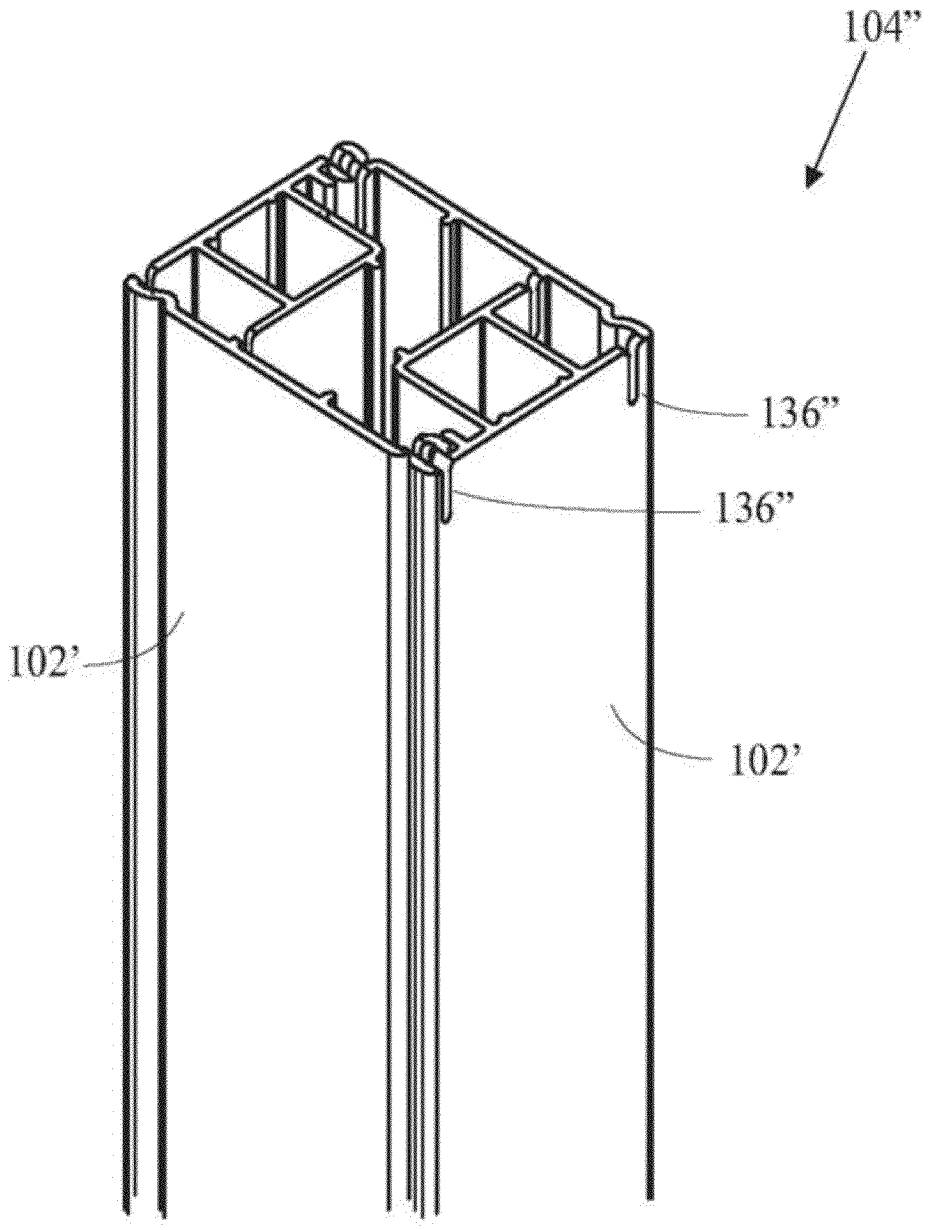
FIG. 46 is a broken away, perspective view of the top portion of the assembled vertical element of FIG. 45, showing the notches to accommodate the vertical flanges of the arched element.
Figure 47:
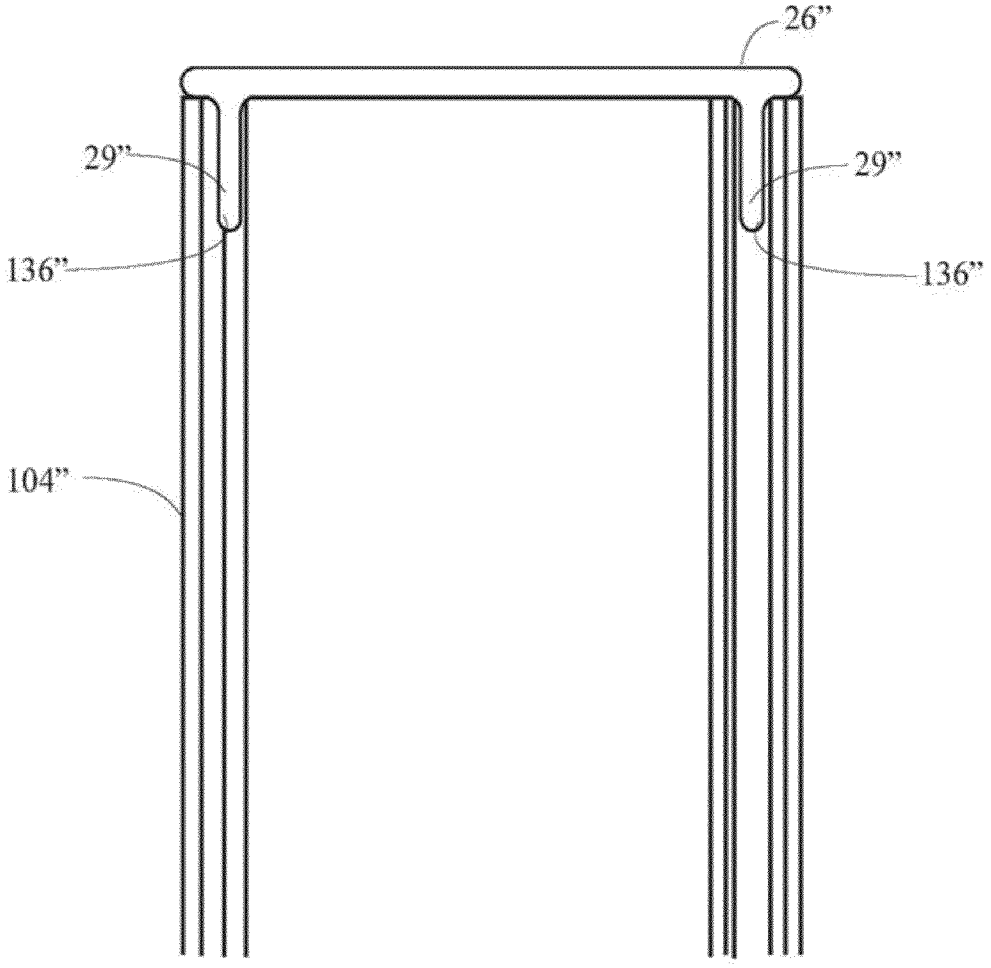
FIG. 47 is a broken away section view of the vertical element of FIG. 46 when assembled together with the arched element.

FIGS. 4549 depict an embodiment of another shutter 10". FIG. 45 is an exploded view of the shutter 10". A comparison with the shutter 10' of FIG. 20 shows that these are almost identical; the main difference is that the arched element 26' of the previous embodiment (See FIG. 20) has a discontinuity 27' of the linear flanges 29' (approximately where the locking plunger 24 is located at the apex of the arched element 26'), but this discontinuity is absent in the arched element 26" of FIG. 45. The discontinuity 27' is present to accommodate the vertical element 104', to ensure that it is able to match up flush up against the arched element 26'. To ensure that the vertical element 104' still matches up flush with the arched element 26" in this embodiment 10", without having to include a discontinuity, the vertical element 104" (See FIG. 46) includes notches 136" extending downwardly just far enough to accommodate the linear flanges 29', as shown in FIG. 47.

Figure 49:
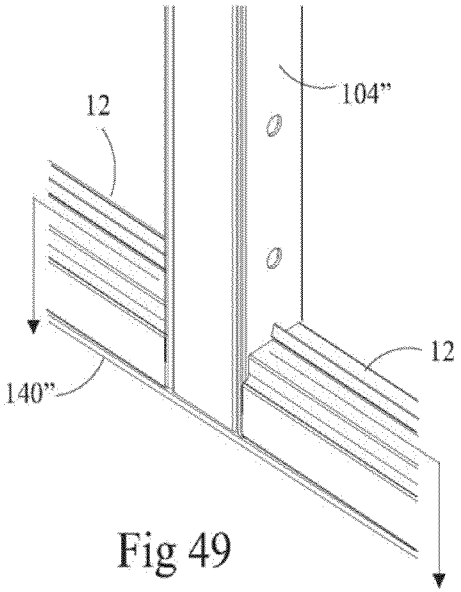
FIG. 49 is a broken away perspective view of the vertical element of FIG. 46 when assembled together with the bottom rails and the bottom plate.
Figure 48:
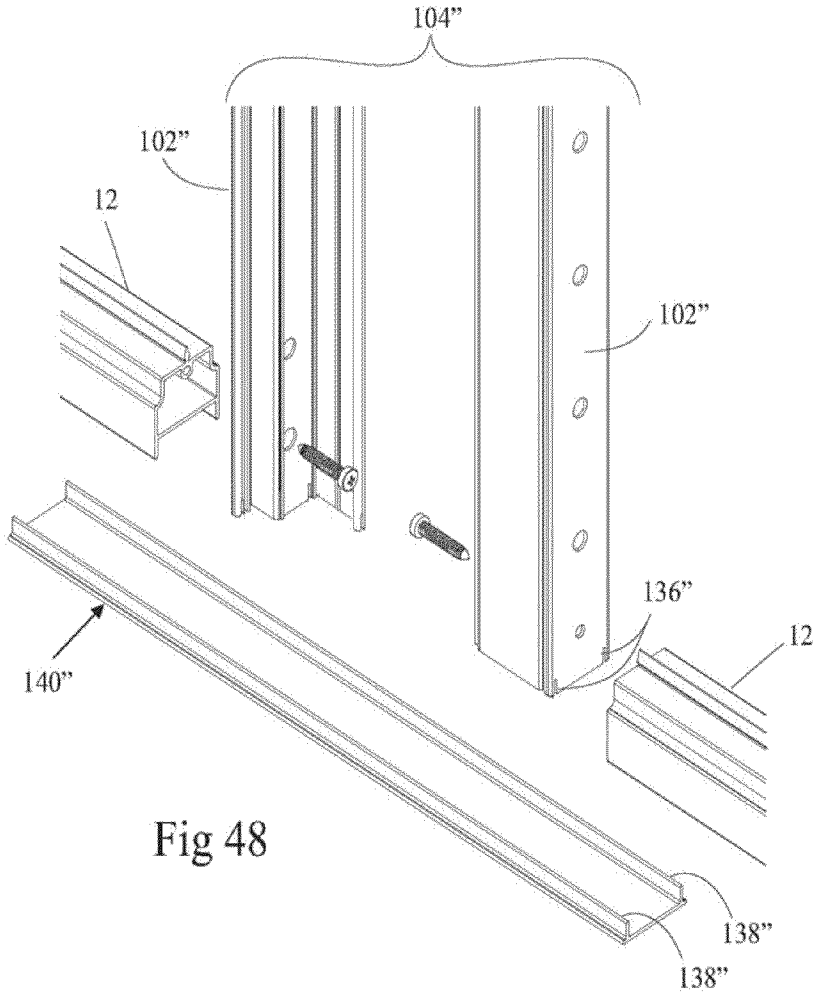
FIG. 48 is a partially broken away, exploded view of the bottom portion of the assembled vertical element of FIG. 45, showing the notches to accommodate the vertical flanges of the bottom plate.

FIGS. 48 and 49 show a similar modification which has been made to the bottom end of the vertical element 104", adding notches 136" to accommodate the linear flanges 138" on the bottom plate 140". The bottom plate 140" replaces the bottom vertical support 110' (See FIG. 20), extending across to both bottom rails 12 to provide additional structural integrity.

It will be obvious to those skilled in the art that modifications may be made to the embodiments described above without departing from the scope of the present invention as defined by the claims. For instance, the coupling shaft connecting two louvers on either side of a vertical member may be omitted if it is desired for the louvers on opposite sides of the vertical member to operate independently. Many other modifications could be made as well.

What is claimed is:

1. A shutter for covering an architectural opening, comprising:

a plurality of frame blocks forming a shutter frame, each of said frame blocks having front and rear faces; a top surface; an outer surface; a vertical inner surface, and a horizontal bottom surface; wherein the plurality of frame blocks includes a first block and a next lower second block, and wherein the bottom surface of the first block rests on the top surface of the next lower second block and extends inwardly beyond the vertical inner surface of the next lower second block to define a cantilevered portion of the first block; and a light stop projection extending downwardly from said cantilevered portion of said first block and recessed from at least one of the front and rear faces of the first block; and a plurality of elongated louvers, each having first and second ends defining a length of said louver from the first end to the second end, and having elongated first and second edges extending along said length, said louvers being arranged parallel to each other and one above the other, with at least one of the ends of each of said louvers being pivotably mounted on a respective one of said frame blocks, wherein said plurality of elongated louvers includes at least one louver mounted on said next lower second block and an adjacent mounted on said first block and positioned louver above said at least one louver, wherein said at least one louver and said adjacent louver are each pivotable between a completely closed first edge up position an open position and a completely closed second edge up position, wherein, in both the completely closed first edge up and completely closed second edge up positions, the edge of said at least one louver which is up vertically overlaps the adjacent louver above said at least one louver for a portion of the length of said at least one louver and overlaps the light stop projection of the first block for another portion of the length of said at least one louver.

2. A shutter for covering an architectural opening, comprising:

a plurality of frame blocks forming a shutter frame, each of said frame blocks having front and rear faces; a top surface; an outer surface; a vertical inner surface, and a horizontal bottom surface; wherein the plurality of frame blocks includes a first block and a next lower second block, and wherein the bottom surface of the first block rests on the top surface of the next lower second block and extends inwardly beyond the vertical inner surface of the next lower second block to define a cantilevered portion of the first block; and a light stop projection extending downwardly from said cantilevered portion of said first block and recessed from at least one of the front and rear faces of the first block; and a plurality of elongated louvers, each having first and second ends defining a length of said louver from the first end to the second end, and having elongated first and second edges extending along said length, said louvers being arranged parallel to each other and one above the other, with at least one of the ends of each of said louvers being pivotably mounted on a respective one of said frame blocks, wherein said plurality of elongated louvers includes at least one louver mounted on said next lower second block and an adjacent louver mounted on said first block and positioned above said at least one louver, wherein said at least one louver is pivotable between a completely closed first edge up position an open position and a completely closed second edge up position, wherein, in both the completely closed first edge up and completely closed second edge up positions, the edge of said at least one louver which is up vertically overlaps the adjacent louver above said at least one louver for a portion of the length of said at least one louver and overlaps the light stop projection of the first block for another portion of the length of said at least one louver, wherein each of said frame blocks defines a lengthwise direction from the outer surface of said frame block to the inner surface of said frame block, and wherein the top surface of said second frame block defines an indentation extending in the lengthwise direction of said second frame block, and wherein the light stop projection of the first frame block extends outwardly beyond the cantilevered portion of the first frame block and is received in said indentation of the second block.

3. A shutter for covering an architectural opening as recited in claim 2 and further comprising a bottom rail having a top surface and a light stop projection extending upwardly from said top surface of said bottom rail.

4. A shutter for covering an architectural opening, comprising:

a plurality of frame blocks forming a shutter frame, each of said frame blocks having front and rear faces; an outer surface; a vertical inner surface; a top surface; and a horizontal bottom surface; wherein said plurality of frame blocks includes a first frame block and a next lower second frame block positioned below said first frame block, and wherein said first frame block includes a cantilevered portion which extends inwardly beyond the vertical inner surface of the next lower second frame block and a light stop projection extending downwardly from said cantilevered portion and recessed from at least one of the front and rear faces of the first frame block; and a plurality of elongated horizontal louvers, each of said louvers having first and second ends defining a length of said louver from the first end to the second end, and having elongated first and second edges extending along said length, said louvers being arranged parallel to each other and including a first louver, which lies above a second louver, with at least one of the ends of the first louver being pivotably mounted on the first frame block for rotation about a first horizontal axis, at least one of the ends of the second louver being pivotably mounted on the second frame block for rotation about a second horizontal axis, wherein said first and second louvers are pivotable between a completely closed first edge up position, a fully open position in which each of said first and second louvers substantially lies in substantially the a horizontal plane, and completely closed second edge up position; wherein substantially the same in both the completely closed positions, and, in both completely closed positions, the edge of the second louver which is up vertically overlaps the first louver for a portion of the length of the second louver and vertically overlaps the light stop projection for another portion of the length of the second louver.

5. A shutter for covering an architectural opening, comprising:

a plurality of frame blocks forming a shutter frame, each of said frame blocks having front and rear faces; an outer surface; a vertical inner surface; a top surface; and a horizontal bottom surface; wherein said plurality of frame blocks includes a first frame block and a next lower second frame block positioned below said first frame block, and wherein said first frame block includes a cantilevered portion which extends inwardly beyond the vertical inner surface of the next lower second frame block and a light stop projection extending downwardly from said cantilevered portion and recessed from at least one of the front and rear faces of the first frame block; and a plurality of elongated horizontal louvers, each of said louvers having first and second ends defining a length of said louver from the first end to the second end, and having elongated first and second edges extending along said length, said louvers being arranged parallel to each other and including a first louver, which lies above a second louver, with at least one of the ends of the first louver being pivotably mounted on the first frame block for rotation about a first horizontal axis, at least one of the ends of the second louver being pivotably mounted on the second frame block for rotation about a second horizontal axis, wherein said first and second louvers are pivotable between a completely closed first edge up position, a fully open position in which each of said first and second louvers substantially lies in a horizontal plane, and a completely closed second edge up position; wherein in both completely closed positions, the edge of the second louver which is up vertically overlaps the first louver for a portion of the length of the second louver and vertically overlaps the light stop projection for another portion of the length of the second louver, wherein each of said frame blocks defines a lengthwise direction extending from the outer surface of said frame block to the inner surface of said frame block, and wherein the top surface of said second frame block defines an indentation extending in the lengthwise direction of said second frame block, and wherein the light stop projection of said first frame block extends outwardly beyond the cantilevered portion of the first frame block and is received in the indentation of the second frame block.

* * * * *

UNITED STATES PATENT AND TRADEMARK OFFICE

CERTIFICATE OF CORRECTION

PATENT NO. : 8,205,384 B2
APPLICATION NO. : 12/465204
DATED : June 26, 2012
INVENTOR(S) : Donald E. Fraser It is certified that error appears in the above-identified patent and that said Letters Patent is hereby corrected as shown below:

Title Page, item (57):
In the Abstract:
Line 1, delete the second "for".

Col. 13-16, lines 18-26,
In the Claims:
The published claims do not properly incorporate changes that were made in an examiner's amendment. In order to properly incorporate those changes, delete claims 1-5 and insert the attached 5 claims.

--1. A shutter for covering an architectural opening, comprising:

a plurality of frame blocks forming a shutter frame, each of said frame blocks having front and rear faces; a top surface; an outer surface; a vertical inner surface, and a horizontal bottom surface;

wherein the plurality of frame blocks includes a first block and a next lower second block, and wherein the bottom surface of the first block rests on the top surface of the next lower second block and extends inwardly beyond the vertical inner surface of the next lower second block to define a cantilevered portion of the first block; and a light stop projection extending downwardly from said cantilevered portion of said first block and recessed from at least one of the front and rear faces of the first block;
and a plurality of elongated louvers, each having first and second ends defining a length of said louver from the first end to the second end and having elongated first and second edges extending along said length, said louvers being arranged parallel to each other and one above the other, with at least one of the ends of each of said louvers being pivotably mounted on a respective one of said frame blocks, wherein said plurality of elongated louvers includes at least one louver mounted on said next lower second block and an adjacent louver mounted on said first block and positioned above said at least one louver, wherein said at least one louver and said adjacent louver are each pivotable between a Signed and Sealed this
Eighteenth Day of September, 2012

David J. Kappos

David J. Kappos
*Director of the United States Patent and Trademark Office* completely closed first edge up position, an open position and a completely closed second edge up position, wherein, in both the completely closed first edge up and completely closed second edge up positions, the edge of said at least one louver which is up vertically overlaps the adjacent louver above said at least one louver for a portion of the length of said at least one louver and overlaps the light stop projection of the first block for another portion of the length of said at least one louver.

2. A shutter for covering an architectural opening, comprising:

a plurality of frame blocks forming a shutter frame, each of said frame blocks having front and rear faces; a top surface; an outer surface; a vertical inner surface, and a horizontal bottom surface; wherein the plurality of frame blocks includes a first block and a next lower second block, and wherein the bottom surface of the first block rests on the top surface of the next lower second block and extends inwardly beyond the vertical inner surface of the next lower second block to define a cantilevered portion of the first block; and a light stop projection extending downwardly from said cantilevered portion of said first block and recessed from at least one of the front and rear faces of the first block;
and a plurality of elongated louvers, each having first and second ends defining a length of said louver from the first end to the second end and having elongated first and second edges extending along said length, said louvers being arranged parallel to each other and one above the other, with at least one of the ends of each of said louvers being pivotably mounted on a respective one of said frame blocks, wherein said plurality of elongated louvers includes at least one louver mounted on said next lower second block and an adjacent louver mounted on said first block and positioned above said at least one louver, wherein said at least one louver is pivotable between a completely closed first edge up position, an open position and a completely closed second edge up position, wherein, in both the completely closed first edge up and completely closed second edge up positions, the edge of said at least one louver which is up vertically overlaps the adjacent louver above said at least one louver for a portion of the length of said at least one louver and overlaps the light stop projection of the first block for another portion of the length of said at least one louver, wherein each of said frame blocks defines a lengthwise direction from the outer surface of said frame block to the inner surface of said frame block, and wherein the top surface of said second frame block defines an indentation extending in the lengthwise direction of said second frame block, and wherein the light stop projection of the first frame block extends outwardly beyond the cantilevered portion of the first frame block and is received in said indentation of the second block.

3. A shutter for covering an architectural opening as recited in claim 2 and further comprising a bottom rail having a top surface and a light stop projection extending upwardly from said top surface of said bottom rail.

4. A shutter for covering an architectural opening, comprising:

a plurality of frame blocks forming a shutter frame, each of said frame blocks having front and rear faces; an outer surface; a vertical inner surface; a top surface; and a horizontal bottom surface;

wherein said plurality of frame blocks includes a first frame block and a next lower second frame block positioned below said first frame block, and wherein said first frame block includes a cantilevered portion which extends inwardly beyond the vertical inner surface of the next lower second frame block and a light stop projection extending downwardly from said cantilevered portion and recessed from at least one of the front and rear faces of the first frame block; and a plurality of elongated horizontal louvers, each of said louvers having first and second ends defining a length of said louver from the first end to the second end and having elongated first and second edges extending along said length, said louvers being arranged parallel to each other and including a first louver which lies above a second louver, with at least one of the ends of the first louver being pivotably mounted on the first frame block for rotation about a first horizontal axis, at least one of the ends of the second louver being pivotably mounted on the second frame block for rotation about a second horizontal axis, wherein said first and second louvers are pivotable between a completely closed first edge up position, a fully open position in which each of said first and second louvers substantially lies in a horizontal plane, and a completely closed second edge up position; wherein in both the completely closed positions, the edge of the second louver which is up vertically overlaps the first louver for a portion of the length of the second louver and vertically overlaps the light stop projection for another portion of the length of the second louver.

5. A shutter for covering an architectural opening, comprising:

a plurality of frame blocks forming a shutter frame, each of said frame blocks having front and rear faces; an outer surface; a vertical inner surface; a top surface; and a horizontal bottom surface; wherein said plurality of frame blocks includes a first frame block and a next lower second frame block positioned below said first frame block, and wherein said first frame block includes a cantilevered portion which extends inwardly beyond the vertical inner surface of the next lower second frame block and a light stop projection extending downwardly from said cantilevered portion and recessed from at least one of the front and rear faces of the first frame block; and a plurality of elongated horizontal louvers, each of said louvers having first and second ends defining a length of said louver from the first end to the second end and having elongated first and second edges extending along said length, said louvers being arranged parallel to each other and including a first louver which lies above a second louver with at least one of the ends of the first louver being pivotably mounted on the first frame block for rotation about a first horizontal axis, at least one of the ends of the second louver being pivotably mounted on the second frame block for rotation about a second horizontal axis, wherein said first and second louvers are pivotable between a completely closed first edge up position, a fully open position in which each of said first and second louvers substantially lies in a horizontal plane, and a completely closed second edge up position; wherein in both the completely closed positions, the edge of the second louver which is up vertically overlaps the first louver for a portion of the length of the second louver and vertically overlaps the light stop projection for another portion of the length of the second louver, wherein each of said frame blocks defines a lengthwise direction extending from the outer surface of said frame block to the inner surface of said frame block, and wherein the top surface of said second frame block defines an indentation extending in the lengthwise direction of said second frame block, and wherein the light stop projection of said first frame block extends outwardly beyond the cantilevered portion of the first frame block and is received in the indentation of the second frame block.--